US011208902B2

(12) United States Patent
Honkomp et al.

(10) Patent No.: US 11,208,902 B2
(45) Date of Patent: Dec. 28, 2021

(54) TIP RAIL COOLING INSERT FOR TURBINE BLADE TIP COOLING SYSTEM AND RELATED METHOD

(71) Applicant: General Electric Company, Schenectady, NY (US)

(72) Inventors: Mark Steven Honkomp, Taylors, SC (US); Mark Lawrence Hunt, Greenville, SC (US); Frederick Whitfield Dantzler, Simpsonville, SC (US); Yan Cui, Greer, SC (US); Ethan Conrad Schaeffer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/876,615

(22) Filed: May 18, 2020

(65) Prior Publication Data

US 2021/0017864 A1 Jan. 21, 2021

Related U.S. Application Data

(63) Continuation-in-part of application No. 16/208,001, filed on Dec. 3, 2018, now Pat. No. 10,934,852.

(51) Int. Cl.

| | |
|---|---|
| ***F01D 5/18*** | (2006.01) |
| ***F01D 25/12*** | (2006.01) |
| ***F01D 5/20*** | (2006.01) |

(52) U.S. Cl.

CPC ..... *F01D 5/188* (2013.01); *F05D 2260/232* (2013.01)

(58) Field of Classification Search

CPC ... F01D 5/20; F01D 5/186; F01D 5/18; F01D 5/147; F01D 5/183; F01D 5/187;

(Continued)

(56) References Cited

U.S. PATENT DOCUMENTS

| | | | |
|---|---|---|---|
| 4,487,550 | A | 12/1984 | Horvath et al. |
| 5,660,523 | A | 8/1997 | Lee |

(Continued)

FOREIGN PATENT DOCUMENTS

| | | | |
|---|---|---|---|
| CN | 111255524 | A | 6/2020 |
| DE | 102019132728 | A1 | 6/2020 |

(Continued)

OTHER PUBLICATIONS

Notice of Allowance and Fee(s) due dated Sep. 30, 2020 for U.S. Appl. No. 16/208,001; pp. 11.

*Primary Examiner* — J. Todd Newton, Esq.
*Assistant Examiner* — Eric J Zamora Alvarez
(74) *Attorney, Agent, or Firm* — Charlotte Wilson; Hoffman Warnick LLC

(57) ABSTRACT

A tip rail cooling insert for attaching into a tip rail pocket in a tip rail of a turbine blade is disclosed. The insert includes a first inner layer defining at least one first insert cooling channel therein, the first inner layer including a pair of spaced legs defining a first coolant collection plenum with at least the tip rail pocket for directing coolant from at least one internal cooling cavity in the turbine blade to the at least one first insert cooling channel. Each of the pair of spaced legs has an angled outer end configured to accommodate rounded inner corners of the tip rail pocket. A first outer layer is on a first side of the first inner layer, and a second outer layer is on a second side of the first inner layer.

20 Claims, 26 Drawing Sheets

(58) Field of Classification Search
CPC ..... F01D 5/188; F01D 5/189; F01D 9/041; F01D 9/042; F05D 2240/12; F05D 2240/81; F05D 2260/201; F05D 2260/202; F05D 2240/307; F05D 2220/32; F05D 2260/204; F05D 2260/205; F05D 2260/20; F05D 2260/232; Y02T 50/676
See application file for complete search history.

(56) References Cited

U.S. PATENT DOCUMENTS

| | | | | |
|---|---|---|---|---|
| 5,690,473 | A * | 11/1997 | Kercher | F01D 5/183 416/97 A |
| 5,738,491 | A | 4/1998 | Lee et al. | |
| 6,412,541 | B2 * | 7/2002 | Roesler | B22C 7/02 164/122.1 |
| 7,922,451 | B1 | 4/2011 | Liang | |
| 7,997,865 | B1 | 8/2011 | Liang | |
| 8,043,058 | B1 | 10/2011 | Liang | |
| 8,066,485 | B1 | 11/2011 | Liang | |
| 9,097,126 | B2 * | 8/2015 | Prue | B23P 6/005 |
| 9,297,262 | B2 | 3/2016 | Zhang | |
| 2016/0089859 | A1 | 3/2016 | Lacy et al. | |

FOREIGN PATENT DOCUMENTS

| | | | |
|---|---|---|---|
| JP | 2020097930 | A | 6/2020 |
| WO | 2017074372 | A1 | 5/2017 |
| WO | 2017167615 | A1 | 10/2017 |

* cited by examiner

TIP RAIL COOLING INSERT FOR TURBINE BLADE TIP COOLING SYSTEM AND RELATED METHOD

This application is a continuation-in-part application of U.S. application Ser. No. 16/208,001, filed Dec. 3, 2018, and currently pending.

BACKGROUND

The disclosure relates generally to turbine components and, more particularly, to a tip rail cooling insert for a turbine blade tip cooling system.

In a gas turbine system, it is well known that air is pressurized in a compressor and used to combust a fuel in a combustor to generate a flow of hot combustion gases, whereupon such gases flow downstream through one or more turbines so that energy can be extracted therefrom. In accordance with such a turbine, generally, rows of circumferentially spaced turbine blades extend radially outwardly from a supporting rotor disk. Each blade typically includes a dovetail that permits assembly and disassembly of the blade in a corresponding dovetail slot in the rotor disk, as well as an airfoil that extends radially outwardly from the dovetail.

The airfoil has a generally concave pressure side wall and a generally convex suction side wall extending axially between corresponding leading and trailing edges and radially between a root and a tip. It will be understood that the blade tip is spaced closely to a radially outer turbine shroud for minimizing leakage therebetween of the combustion gases flowing downstream between the turbine blades. Maximum efficiency of the system is obtained by minimizing the tip clearance or gap such that leakage is prevented, but this strategy is limited somewhat by the different thermal and mechanical expansion and contraction rates between the turbine blades and the turbine shroud and the motivation to avoid an undesirable scenario of having excessive tip rub against the shroud during operation.

In addition, because turbine blades are bathed in hot combustion gases, effective cooling is required to ensure a useful part life. Typically, the blade airfoils are hollow and disposed in fluid communication with the compressor so that a portion of pressurized air bled therefrom is received for use in cooling the airfoils, as a coolant. Airfoil cooling is quite sophisticated and may be employed using various forms of internal cooling channels and features, as well as cooling holes through the outer rail surfaces of the airfoil for discharging the coolant. Nevertheless, airfoil tips are particularly difficult to cool since they are located directly adjacent to the turbine shroud and are heated by the hot combustion gases that flow through the tip gap. Accordingly, a portion of the air channeled inside the airfoil of the blade is typically discharged through the tip for the cooling thereof.

It will be appreciated that conventional blade tips include several different geometries and configurations that are meant to prevent leakage and increase cooling effectiveness. Conventional blade tips, however, all have certain shortcomings, including a general failure to adequately reduce leakage and/or allow for efficient tip cooling that minimizes the use of efficiency-robbing compressor bypass air. One approach, referred to as a "squealer tip" arrangement, provides a radially extending rail that may rub against the tip shroud. The rail reduces leakage and therefore increases the efficiency of turbine engines.

However, the rail of the squealer tip is subjected to a high heat load, and, because is difficult to effectively cool, it is frequently one of the hottest regions in the blade. Tip rail impingement cooling delivers coolant through the top of the rail and has been demonstrated to be an effective method of rail cooling. However, there are numerous challenges associated with exhausting a coolant through the top of the rail. For example, backflow pressure margin requirements are difficult to satisfy with this arrangement (especially on the pressure side wall, where there are holes connected to low and high pressure regions—the top and pressure side walls of the rail, respectively). Hence, it is a challenge to create losses in the tip passage to back-pressure the coolant flow and at the same time sufficiently cool the rail, since losses reduce the amount of coolant used in this region. Further, the outlet holes must exhibit rub tolerance yet provide sufficient cooling to the rails. For example, the outlet holes must be tolerant of tip rub but also sufficiently large that dust cannot clog them. It is also desirable to maintain the cooling after tip wear, e.g., by exposing supplemental cooling channels.

Ideally, the rail cooling passages are also capable of formation using additive manufacturing, which presents further challenges. Additive manufacturing (AM) includes a wide variety of processes of producing a component through the successive layering of material rather than the removal of material. As such, additive manufacturing can create complex geometries without the use of any sort of tools, molds or fixtures and with little or no waste material. Instead of machining components from solid billets of material, much of which is cut away and discarded, the only material used in additive manufacturing is what is required to shape the component. With regard to tip rail cooling passages, conventional circular cooling holes within the rail are very difficult to build using additive manufacturing (perpendicular to the nominal build direction) and can severely deform or collapse during manufacture.

Another challenge with tip cooling is accommodating the different temperatures observed in different areas of the tip rail. For example, the rail in the pressure side wall and aft region of the suction side wall are typically hotter than other areas. Another challenge is providing cooling in used turbine blades that did not initially include tip cooling passages.

BRIEF DESCRIPTION

A first aspect of the disclosure provides a turbine blade tip cooling system including: a turbine blade having a tip cavity, a tip rail surrounding at least a portion of the tip cavity and at least one internal cooling cavity; the tip rail having an inner rail surface, an outer rail surface, an end surface and at least one tip rail pocket open at the end surface and fluidly connected to the at least one internal cooling cavity that carries a coolant; and a tip rail cooling insert attached to the at least one tip rail pocket, the tip rail cooling insert having at least one insert cooling channel and a coolant collection plenum for directing coolant from the at least one internal cooling cavity to the at least one insert cooling channel.

A second aspect of the disclosure provides a method of cooling a turbine blade tip including: providing a turbine blade having a tip cavity, a tip rail surrounding least a portion of the tip cavity and at least one internal cooling cavity configured to deliver a coolant, the tip rail having an inner rail surface, an outer rail surface and an end surface; forming a tip rail pocket in the end surface of the tip rail, the tip rail pocket including a tip rail pocket coolant opening in fluid communication with the at least one internal cooling cavity; forming a tip rail cooling insert having a coolant collection plenum configured for fluid communication with the tip rail pocket coolant opening and at least one insert cooling channel in fluid communication with the coolant collection plenum, the tip rail cooling insert being sized and shaped to engage in the tip rail pocket; and attaching the tip rail cooling insert to the tip rail pocket to fluidly connect the coolant collection plenum to the internal cooling cavity.

A third aspect provides a gas turbine having a rotating blade, the gas turbine including: a turbine blade having a tip cavity, a tip rail surrounding at least a portion of the tip cavity and at least one internal cooling cavity; the tip rail having an inner rail surface, an outer rail surface, an end surface and at least one tip rail pocket open at the end surface, the at least one tip rail pocket fluidly connected to the at least one internal cooling cavity; and a tip rail cooling insert attached to the at least one tip rail pocket, the tip rail cooling insert having at least one insert cooling channel and a coolant collection plenum for directing coolant from the at least one internal cooling cavity to the at least one insert cooling channel.

A fourth aspect includes a tip rail cooling insert for attaching into a tip rail pocket in a tip rail of a turbine blade, the tip rail cooling insert including: a first inner layer defining at least one first insert cooling channel therein, the first inner layer including a first pair of spaced legs defining a first coolant collection plenum with at least the tip rail pocket for directing coolant from at least one internal cooling cavity in the turbine blade to the at least one first insert cooling channel, wherein each of the first pair of spaced legs has an angled outer end configured to accommodate rounded inner corners of the tip rail pocket; a first outer layer on a first side of the first inner layer; and a second outer layer on a second side of the first inner layer.

A fifth aspect relates to a turbine blade tip cooling system, including: a turbine blade having a tip cavity, a tip rail surrounding at least a portion of the tip cavity, and at least one internal cooling cavity that carries a coolant; the tip rail having an inner rail surface, an outer rail surface, an end surface and a tip rail pocket open at the end surface and fluidly connected to the at least one internal cooling cavity, the tip rail pocket having rounded inner corners; and a tip rail cooling insert attached to the tip rail pocket, the tip rail cooling insert including: a first inner layer defining at least one first insert cooling channel therein, the first inner layer including a first pair of spaced legs defining a first coolant collection plenum for directing coolant from the at least one internal cooling cavity to the at least one first insert cooling channel, wherein each of the first pair of spaced legs has an angled outer end configured to accommodate the rounded inner corners of the tip rail pocket; a first pre-sintered preform (PSP) outer layer on a first side of the first inner layer; and a second PSP outer layer on a second side of the first inner layer.

A sixth aspect includes a method, including: forming a tip rail pocket in an end surface of a tip rail of a turbine blade, the turbine blade having a tip cavity, the tip rail surrounding least a portion of the tip cavity, and at least one internal cooling cavity configured to deliver a coolant, and wherein the tip rail pocket includes rounded inner corners and a tip rail pocket coolant opening in fluid communication with the at least one internal cooling cavity of the turbine blade; inserting a tip rail cooling insert into the tip rail pocket, the tip rail cooling insert including: a first inner layer defining at least one insert cooling channel therein, the first inner layer including a first pair of spaced legs defining a first coolant collection plenum for directing coolant from the at least one internal cooling cavity to the at least one first insert cooling channel, wherein each of the first pair of spaced legs has an angled outer end configured to accommodate the rounded inner corners of the tip rail pocket; a first outer layer on a first side of the first inner layer; and a second outer layer on a second side of the first inner layer; and securing the tip rail cooling insert to the tip rail pocket to fluidly connect the coolant collection plenum to the internal cooling cavity.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
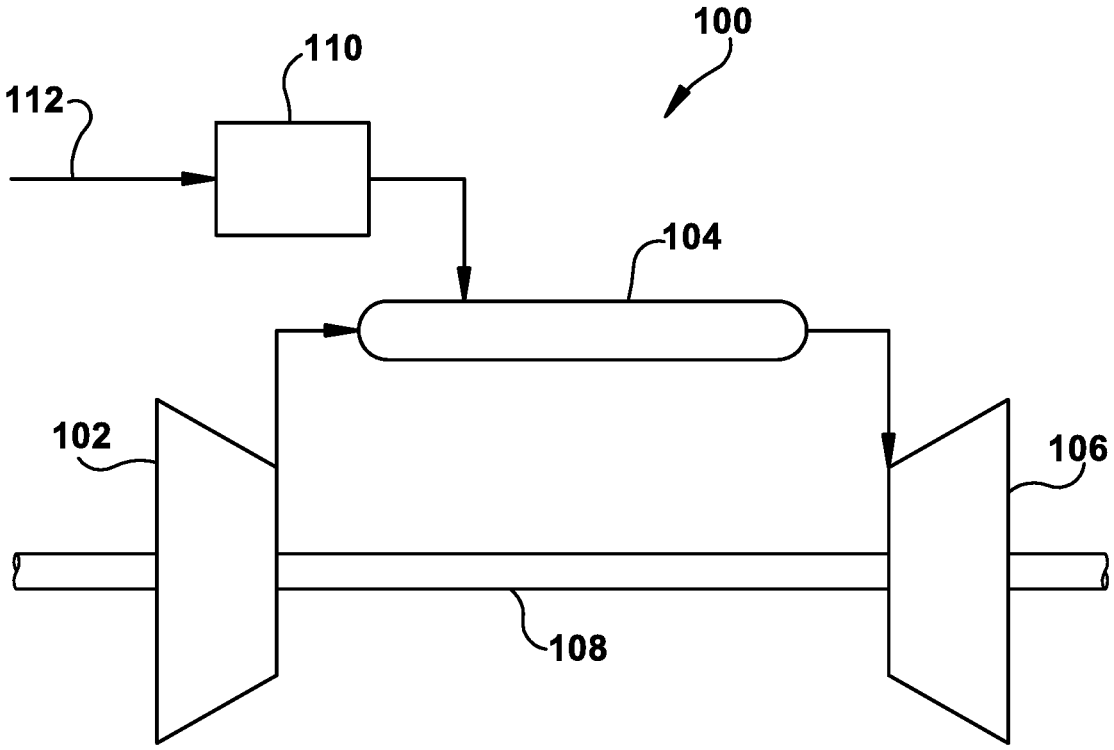
Fig. 1 (Prior Art)
FIG. 1 is a schematic diagram of an embodiment of a turbomachine system.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

As an initial matter, in order to clearly describe the current disclosure, it will become necessary to select certain terminology when referring to and describing relevant machine components within a turbomachine system and relative to a turbine blade. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a working fluid, such as combustion gases through the turbine engine or, for example, the flow of air through the combustor or coolant through or by one of the turbine's components. The term "downstream" corresponds to the direction of flow of the fluid, and the term "upstream" refers to the direction opposite to the flow. The terms "forward" and "aft," without any further specificity, refer to directions, with "forward" referring to an upstream portion of the part being referenced, i.e., closest to compressor, and "aft" referring to a downstream portion of the part being referenced, i.e., farthest from compressor.

It is often required to describe parts that are at differing radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

Where an element or layer is referred to as being "on," "engaged to," "connected to," or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, embodiments of the disclosure provide a turbine blade tip cooling system for a turbine blade including a tip rail cooling insert. A turbine blade has a tip cavity, a tip rail surrounding at least a portion of the tip cavity, and at least one internal cooling cavity, i.e., an internal cooling cavity carrying a coolant disposed within the airfoil. The tip cavity can be created by a tip plate and the tip rail. The tip rail extends radially from the tip plate. The tip rail has an inner rail surface, an outer rail surface, an end surface, and at least one tip rail pocket open at the end surface. That is, the tip rail may include an inner rail surface defining a tip cavity therein, an outer rail surface, and an end surface (e.g., a radially outward facing rail surface) between the inner rail surface and the outer rail surface. The tip rail pocket is fluidly connected to the at least one internal cooling cavity that carries a coolant.

A tip rail cooling insert attaches to the at least one tip rail pocket and has insert cooling channel(s) and a coolant collection plenum for directing coolant from the at least one internal cooling cavity to the insert cooling channel(s). Insert cooling channel(s) can take a variety of forms to provide a wide variety of desired cooling. The tip rail cooling insert allows for selectively placed cooling of the tip rail in used or new turbine blades. The tip rail cooling insert is configured to deliver coolant to those areas of the tip and/or tip rail (e.g., the suction side, aft portion thereof) requiring additional cooling compared to other parts of the tip. The tip rail cooling insert may also improve cooling of the tip rail while metering coolant therethrough. The tip rail cooling insert may also address dust clogging.

Certain embodiments of the tip rail cooling insert allow for additive manufacturing, among other manufacturing processes, as described herein. Additive manufacturing (AM) includes a wide variety of processes of producing a component through the successive layering of material rather than the removal of material. Additive manufacturing techniques typically include taking a three-dimensional computer aided design (CAD) file of the component to be formed, electronically slicing the component into layers, e.g., 18-102 micrometers thick, and creating a file with a two-dimensional image of each layer, including vectors, images or coordinates. The file may then be loaded into a preparation software system that interprets the file such that the component can be built by different types of additive manufacturing systems. In 3D printing, rapid prototyping (RP), and direct digital manufacturing (DDM) forms of additive manufacturing, material layers are selectively dispensed, sintered, formed, deposited, etc., to create the component.

In metal powder additive manufacturing techniques, such as direct metal laser melting (DMLM) (also referred to as selective laser melting (SLM)), metal powder layers are sequentially melted together to form the component. More specifically, fine metal powder layers are sequentially melted after being uniformly distributed using an applicator on a metal powder bed. Each applicator includes an applicator element in the form of a lip, brush, blade or roller made of metal, plastic, ceramic, carbon fibers or rubber that spreads the metal powder evenly over the build platform. The metal powder bed can be moved in a vertical axis. The process takes place in a processing chamber having a precisely controlled atmosphere. Once each layer is created, each two-dimensional slice of the component geometry can be fused by selectively melting the metal powder. The melting may be performed by a high-powered melting beam, such as a 100 Watt ytterbium laser, to fully weld (melt) the metal powder to form a solid metal. The melting beam moves in the X-Y direction using scanning mirrors and has an intensity sufficient to fully weld (melt) the metal powder to form a solid metal. The metal powder bed may be lowered for each subsequent two-dimensional layer, and the process repeats until the component is completely formed.

FIG. 1 is a schematic diagram of an embodiment of a turbomachine system, such as a gas turbine system 100. System 100 includes a compressor 102, a combustor 104, a turbine 106, a shaft 108 and a fuel nozzle 110. In an embodiment, system 100 may include a plurality of compressors 102, combustors 104, turbines 106, shafts 108 and fuel nozzles 110. Compressor 102 and turbine 106 are coupled by shaft 108. Shaft 108 may be a single shaft or a plurality of shaft segments coupled together to form shaft 108.

In one aspect, combustor 104 uses liquid and/or gas fuel, such as natural gas or a hydrogen rich synthetic gas, to run the engine. For example, fuel nozzles 110 are in fluid communication with an air supply and a fuel supply 112. Fuel nozzles 110 create an air-fuel mixture and discharge the air-fuel mixture into combustor 104, thereby causing a combustion that creates a hot pressurized exhaust gas. Combustor 104 directs the hot pressurized gas through a transition piece into a turbine nozzle (or "stage one nozzle"), and other stages of buckets and nozzles causing turbine 106 rotation. The rotation of turbine 106 causes shaft 108 to rotate, thereby compressing the air as it flows into compressor 102.

In an embodiment, hot gas path components, including, but not limited to, shrouds, diaphragms, nozzles, blades and transition pieces are located in turbine 106, where hot gas flow across the components causes creep, oxidation, wear and thermal fatigue of turbine parts. Controlling the temperature of the hot gas path components can reduce distress modes in the components. The efficiency of the gas turbine increases with an increase in firing temperature in turbine system 100. As the firing temperature increases, the hot gas path components need to be properly cooled to meet service life. Components with improved arrangements for cooling of regions proximate to the hot gas path and methods for making such components are discussed in detail herein. Although the following discussion primarily focuses on gas turbines, the concepts discussed are not limited to gas turbines.

Figure 2:
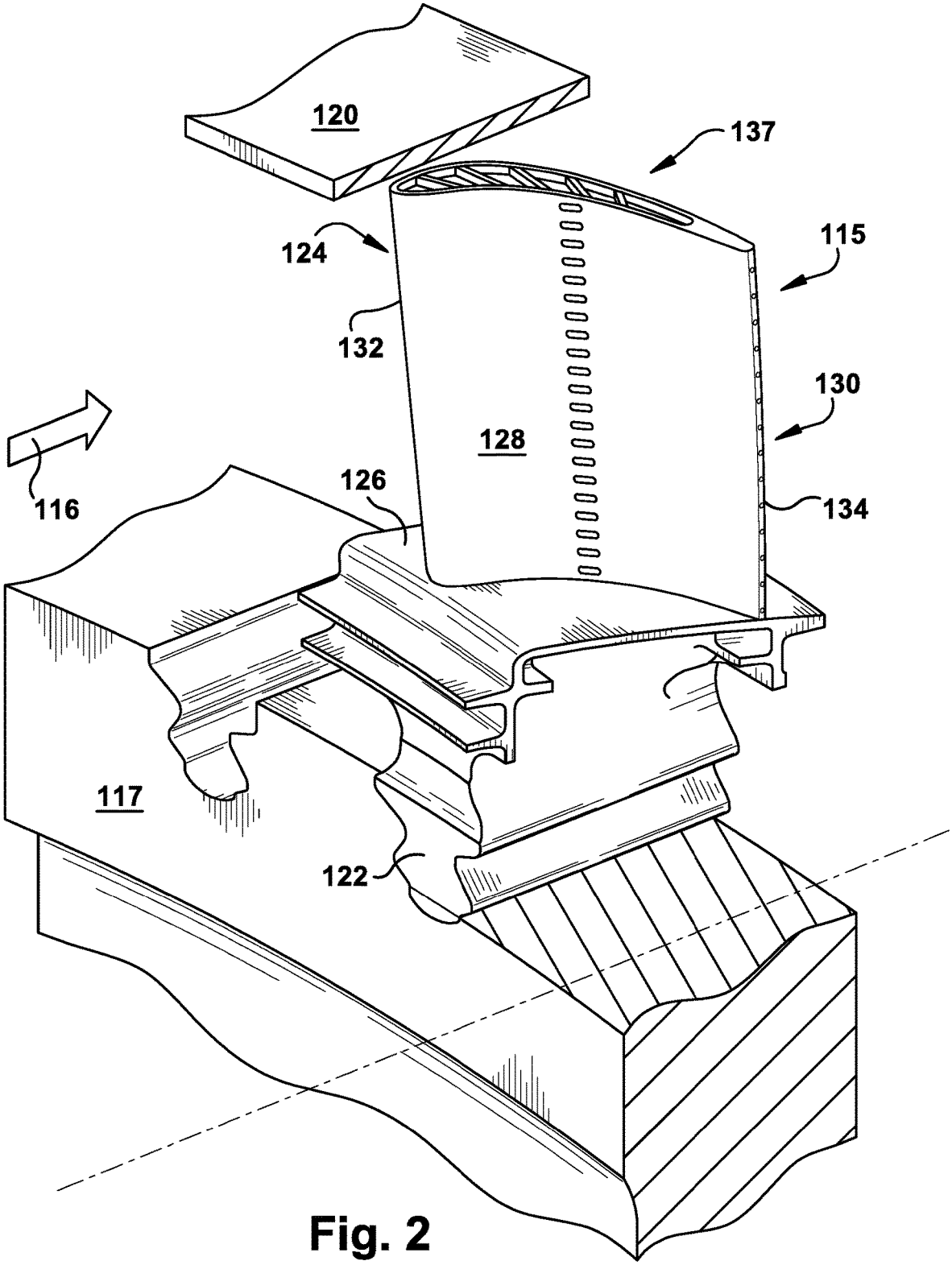
Fig. 2 (Prior Art)
FIG. 2 is a perspective view of an illustrative turbine component in the form of a turbine blade assembly including a rotor disk, a turbine blade, and a stationary shroud.

FIG. 2 is a perspective view of an illustrative conventional turbine component, a turbine blade 115 which is positioned in a turbine of a gas turbine system. It will be appreciated that the turbine is mounted downstream from a combustor for receiving hot combustion gases 116 therefrom. The turbine, which is axisymmetric about an axial centerline axis, includes a rotor disk 117 and a plurality of circumferentially spaced apart turbine blades 115 (only one of which is shown) extending radially outwardly from rotor disk 117 along a radial axis. Rotor disk 117 is coupled to shaft 108 (FIG. 1). An annular, stationary turbine shroud 120 is suitably joined to a stationary stator casing (not shown) and surrounds turbine blades 115 such that a relatively small clearance or gap remains therebetween that limits leakage of combustion gases during operation.

Each turbine blade 115 generally includes a base 122 (also referred to as a root or dovetail), which may have any conventional form, such as an axial dovetail configured for being mounted in a corresponding dovetail slot in the perimeter of rotor disk 117. A hollow airfoil 124 is integrally joined to base 122 and extends radially or longitudinally outwardly therefrom. Turbine blade 115 also includes an integral platform 126 disposed at the junction of airfoil 124 and base 122 for defining a portion of the radially inner flow path for combustion gases 116. It will be appreciated that turbine blade 115 may be formed in any conventional manner and is typically a one-piece casting, an additively manufactured part, or an additively manufacturing tip joined to a cast blade base section. It will be seen that airfoil 124 preferably includes a generally concave pressure side wall 128 and a circumferentially or laterally opposite, generally convex suction side wall 130 extending axially between opposite leading and trailing edges 132 and 134, respectively. Side walls 128 and 130 also extend in the radial direction from platform 126 to a radially outer blade tip or, simply, tip 137.

Figure 3:
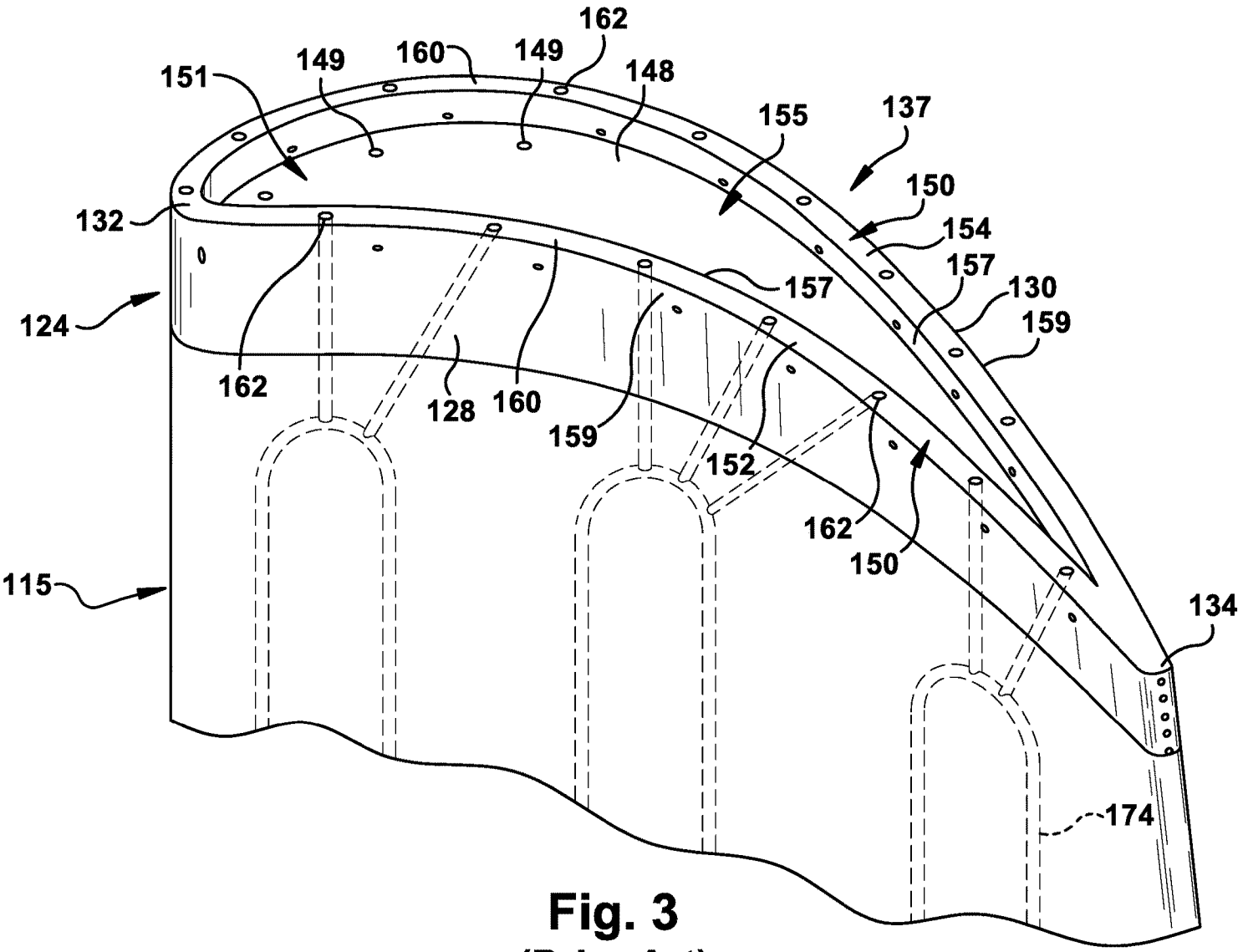
Fig. 3 (Prior Art)
FIG. 3 is a close-up, solid perspective view of the tip of a turbine component in the form of a turbine blade in which embodiments of the disclosure may be used.

FIG. 3 provides a close-up, perspective view of an illustrative turbine blade tip 137 on which embodiments of the present disclosure may be employed. In general, turbine blade 115 has a tip cavity 155, a tip rail 150 surrounding at least a portion of tip cavity 155, and at least one internal cooling cavity 174. Blade tip 137 is disposed opposite base 122 (FIG. 2) and includes a tip plate 148 defining an outwardly facing tip end 151 between pressure side wall 128 and suction side wall 130. Tip plate 148 typically bounds internal cooling passages (which will be simply referenced herein as an "internal cooling cavity" 174 (also referred to as an "airfoil chamber")) disposed within airfoil 124 and defined between pressure side wall 128 and suction side wall 130 of airfoil 124. Internal cooling cavity 174 is configured to supply a coolant through airfoil 124, e.g., in a radial direction. That is, coolant, such as compressed air bled from the compressor, may be circulated through the internal cooling cavity 174 during operation. The internal cooling cavity 174 may include any now known or later developed coolant carrying passages or circuits including but not limited to: cooling passages, impingement sleeves or elements, connecting passages, cavities, pedestals, etc. Tip plate 148 may be integral to turbine blade 115, or it may be welded/brazed into place after the blade is cast.

Due to certain performance advantages, such as reduced leakage flow, blade tips 137 frequently include tip rail 150. Coinciding with pressure side wall 128 and suction side wall 130, tip rail 150 may be described as including a pressure side wall rail 152 and a suction side wall rail 154, respectively. Generally, pressure side wall rail 152 extends radially outwardly from tip plate 148 and extends from leading edge 132 to trailing edge 134 of airfoil 124. As illustrated, the path of pressure side wall rail 152 is adjacent to or near the outer radial edge of pressure side wall 128 (i.e., at or near the periphery of tip plate 148 such that it aligns with the outer radial edge of the pressure side wall 128). Similarly, as illustrated, suction side wall rail 154 extends radially outwardly from tip plate 148 and may extend from leading edge 132 to trailing edge 134 of airfoil 124. The path of suction side wall rail 154 is adjacent to or near the outer radial edge of suction side wall 130 (i.e., at or near the periphery of the tip plate 148 such that it aligns with the outer radial edge of the suction side wall 130).

Both pressure side wall rail 152 and suction side wall rail 154 may be described as having an inner rail surface 157, an outer rail surface 159 and an end surface 160, e.g., a radially outward facing rail surface, between inner rail surface 157 and outer rail surface 159. It should be understood though that rail(s) may not necessarily follow the pressure or suction side wall rails. That is, in alternative types of tips in which the present disclosure may be used, tip rails 150 may be moved away from the edges of tip plate 148 and may not extend to trailing edge 134.

Formed in this manner, it will be appreciated that tip rail 150 defines tip cavity 155 at tip 137 of turbine blade 115. As one of ordinary skill in the art will appreciate, tip 137 configured in this manner, i.e., one having this type of tip cavity 155, is often referred to as a "squealer tip" or a tip having a "squealer pocket" or "squealer cavity." The height and width of pressure side wall rail 152 and/or suction side wall rail 154 (and thus the depth of tip cavity 155) may be varied depending on best performance and the size of the overall turbine assembly. It will be appreciated that tip plate 148 forms the floor of tip cavity 155 (i.e., the inner radial boundary of the cavity), tip rail 150 forms the side walls of tip cavity 155, and tip cavity 155 remains open through an outer radial face, which, once installed within a turbine engine, is bordered closely by annular, stationary turbine shroud 120 (see FIG. 2) that is slightly radially offset therefrom. End surface 160 (radially outward facing rail surface) of tip rail 150 may rub against annular, stationary turbine shroud 120.

As understood in the art, tip rail 150 may have any of a variety of cooling passages (not shown) extending therethrough to cool the tip rail. Some outlets 162 of those cooling passages are shown, for example, in FIGS. 3 and 4. Blade tip cooling system 200 in accordance with the disclosure may be used in tip rails 150 that do not include such cooling passages. In this case, blade tip cooling system 200 may be the only cooling system provided. Alternatively, blade tip cooling system 200 according to the disclosure may be added to a tip rail that already includes such cooling passages, but requires supplemental cooling, e.g., in particular areas thereof.

Figure 4:
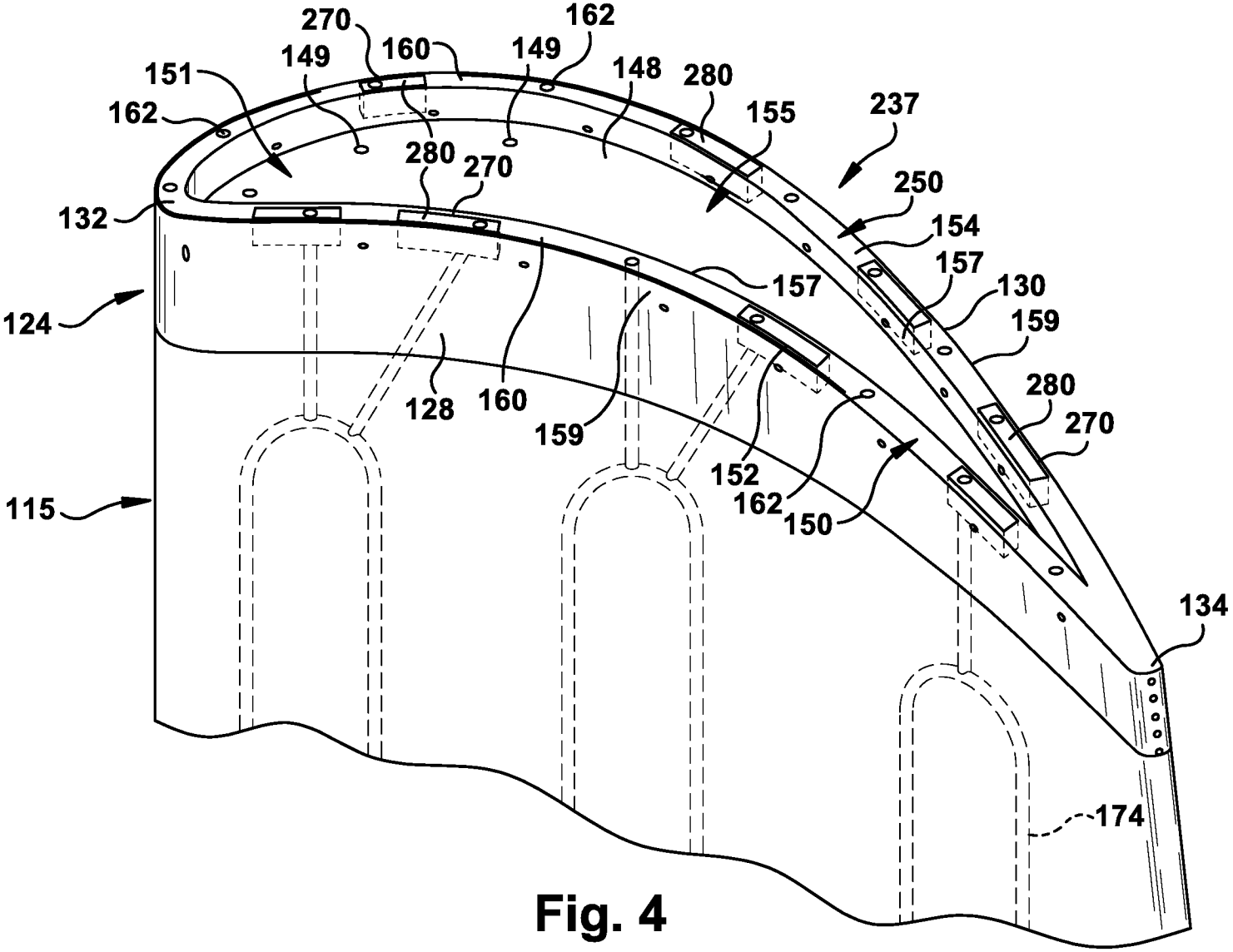
FIG. 4 is a close-up, see-through perspective view of the tip of a turbine component in the form of a turbine blade including a tip rail cooling insert, according to embodiments of the disclosure.

FIG. 4 shows a close-up, perspective view of an illustrative turbine blade tip cooling system 200 (hereinafter "system 200") for a turbine blade tip 237, according to embodiments of the disclosure. As understood in the art, a tip rail 250 may have any of a variety of cooling passages (not shown) extending therethrough to cool the tip rail. Some outlets 162 of those cooling passages are shown, for example, in FIGS. 3 and 4. Blade tip cooling system 200 in accordance with the disclosure may be used in tip rails 250 that do not include such cooling passages. In this case, blade tip cooling system 200 may be the only cooling system provided. Alternatively, blade tip cooling system 200 according to the disclosure may be added to a tip rail that already includes such cooling passages, but that requires supplemental cooling, e.g., in particular areas thereof.

Figure 5:
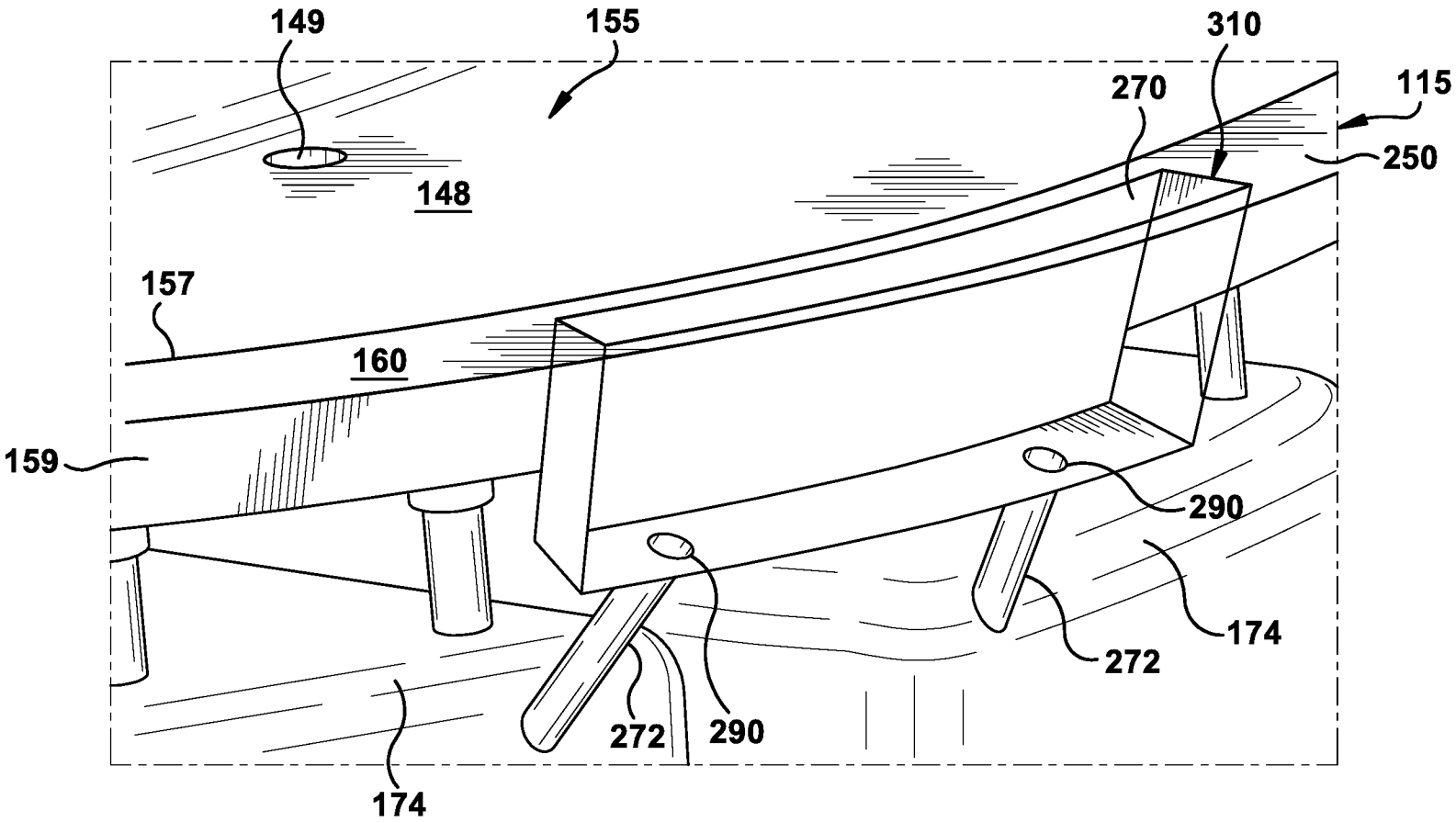
FIG. 5 is an enlarged, see-through perspective view of a tip rail pocket in a tip rail, according to embodiments of the disclosure.
Figure 6:
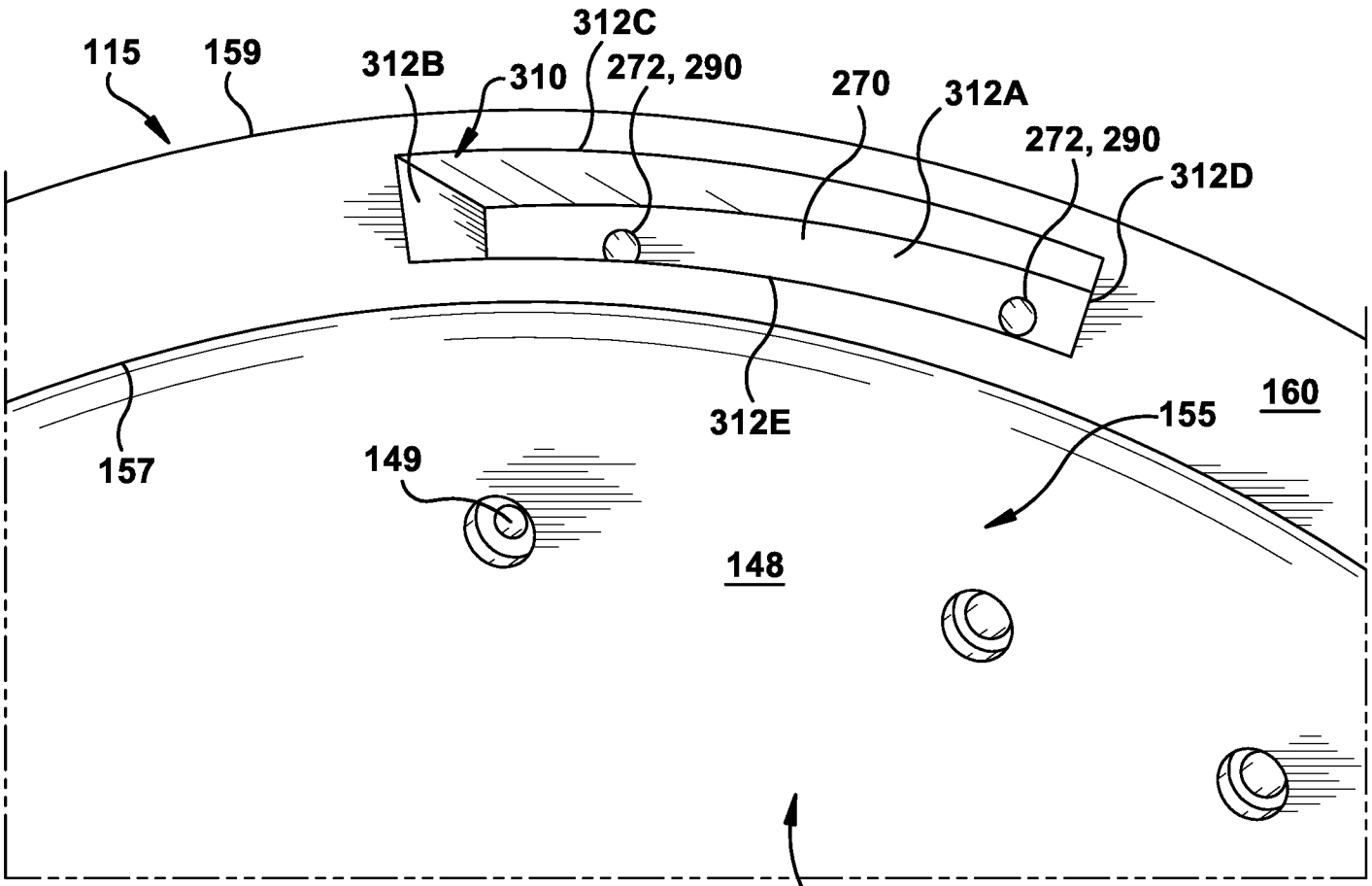
FIG. 6 is a plan view of a tip rail pocket in a tip rail, according to embodiments of the disclosure.

With continuing reference to FIG. 4, tip 237 is substantially similar to tip 137 in FIG. 3, except tip cooling insert(s) 280 is/are provided in tip rail 250. Tip rail 250 has inner rail surface 157, outer rail surface 159, and end surface 160. In contrast to conventional tip rails, tip rail 250 also has at least one tip rail pocket 270 open at end surface 160. FIG. 5 shows an enlarged, see-through view, and FIG. 6 shows a plan view of an illustrative tip rail pocket 270 without a tip rail cooling insert 280 therein. Each tip rail pocket 270 is fluidly connected to the at least one internal cooling cavity 174 that carries a coolant, e.g., via blade cooling channel(s) 272.

Figure 7:
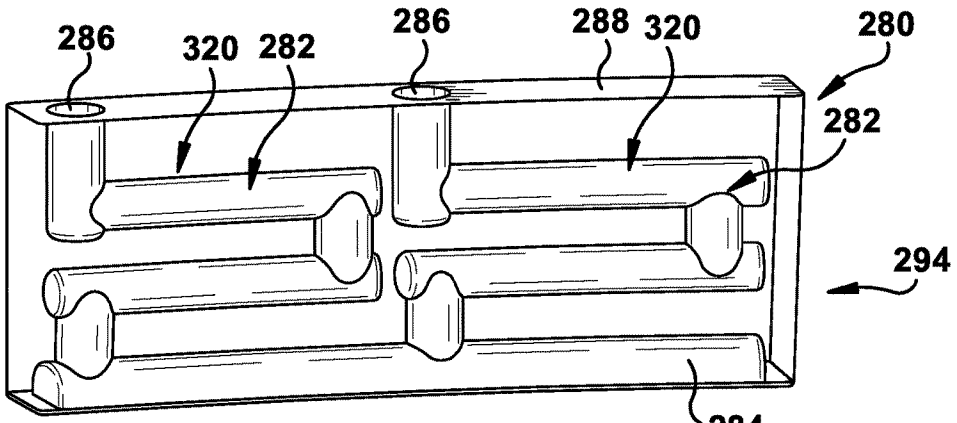
FIG. 7 is a perspective view of a tip rail cooling insert, according to embodiments of the disclosure.
Figure 8:
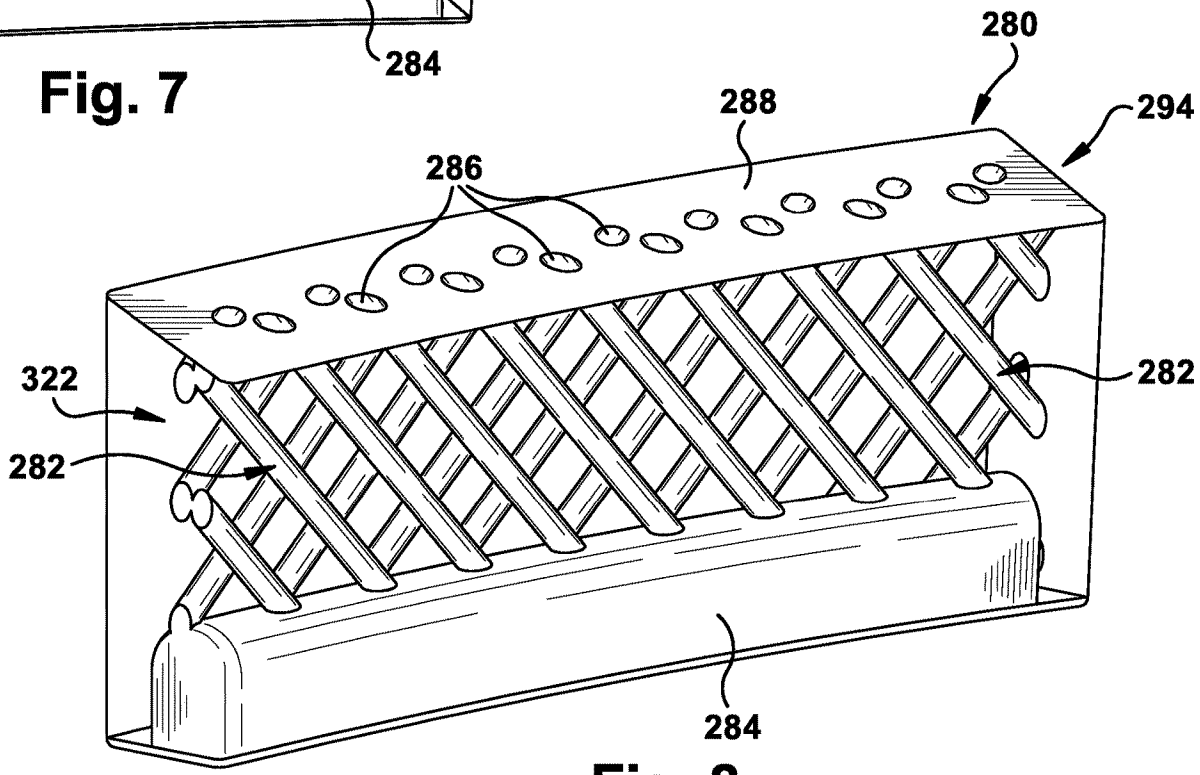
FIG. 8 is a perspective view of a tip rail cooling insert, according to embodiments of the disclosure.

As shown in FIG. 4, system 200 also includes a tip rail cooling insert 280 attached to each tip rail pocket 270. FIGS. 7 and 8 show perspective views of illustrative tip rail cooling inserts 280. As illustrated, each tip rail cooling insert 280 includes at least one insert cooling channel 282 therein and a coolant collection plenum 284 for directing coolant from internal cooling cavity(ies) 174 to insert cooling channel(s) 282. As will be described in greater detail, insert cooling channel(s) 282 can take a variety of paths through tip rail cooling insert 280 (hereinafter simply "insert 280"). One or more of insert cooling channels 282 may exit through at least one coolant exit aperture 286 in an end surface 288 (radially outer) of a respective insert 280. Any number of tip rail pockets 270 and respective inserts 280 attached to each of the plurality of tip rail pockets can be provided in a tip rail 250. In this manner, as will be described, cooling can be provided where necessary.

Tip rail pockets 270 can be made in any now known or later developed fashion. For example, for new blades, tip rail pockets 270 can be formed by casting or additive manufacturing. For used blades, tip rail pockets 270 can be formed in end surface 160 of the tip rail, for example, by electrodischarge machining (EDM), i.e., by cutting a part of tip rail 250 out to form the pocket. If not already provided, blade cooling channel(s) 272 can be, for example, drilled to create fluid communication with the at least one internal cooling cavity 174.

Figure 9:
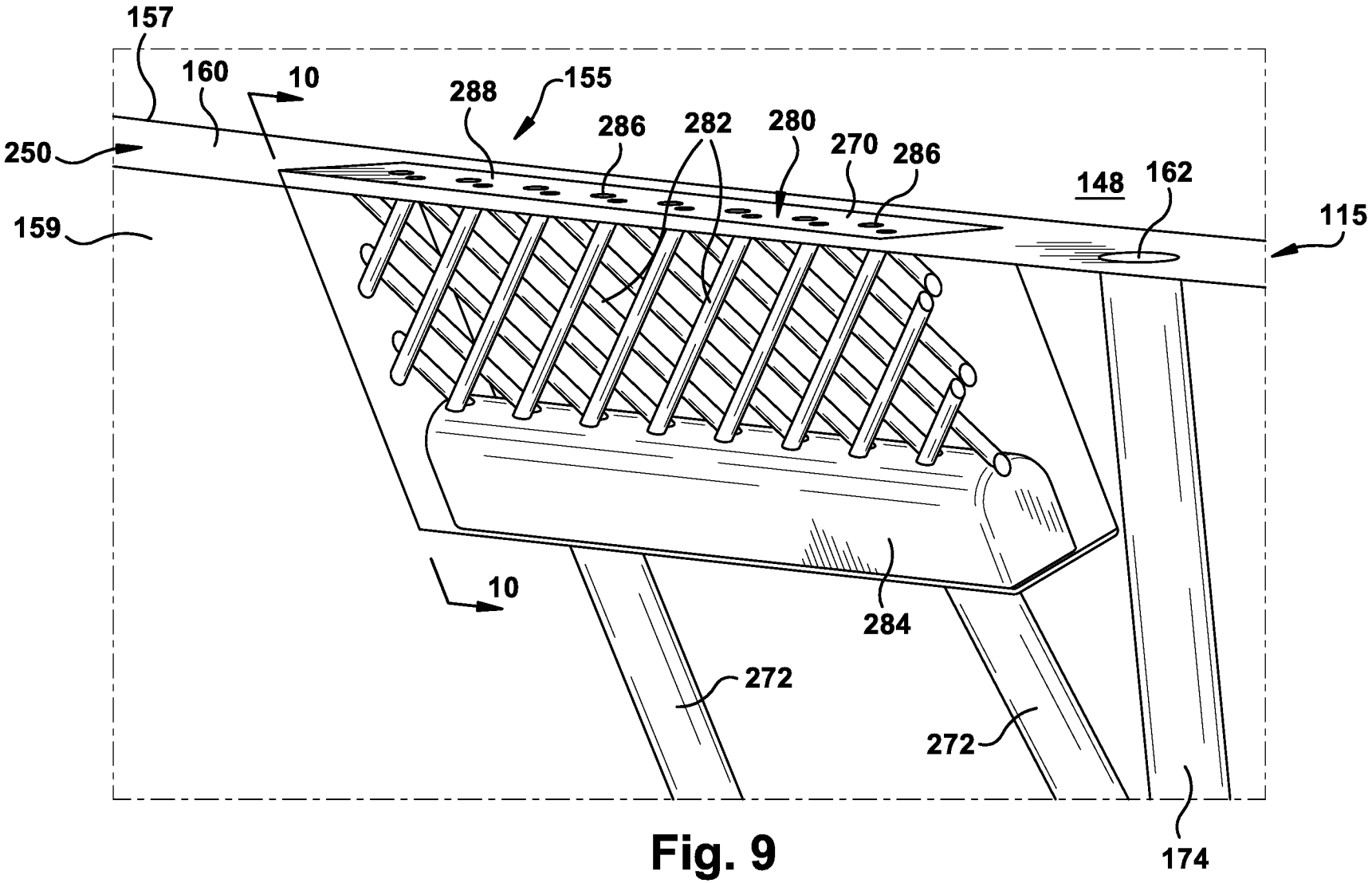
FIG. 9 is a perspective view of a tip rail cooling insert in a tip rail, according to embodiments of the disclosure.
Figure 10:
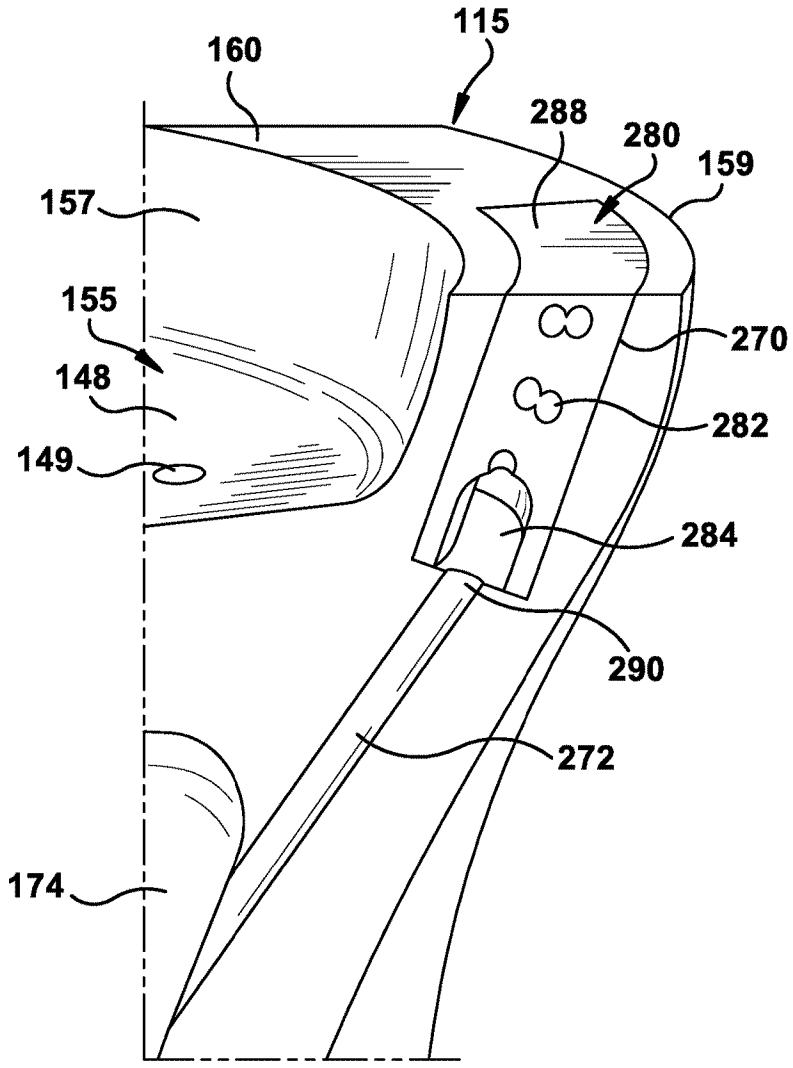
FIG. 10 is a cross-sectional view along line 10-10 in FIG. 9 of a tip rail cooling insert, according to embodiments of the disclosure.

FIG. 9 shows a perspective, see-through view, and FIG. 10 shows a radial cross-sectional view of an illustrative insert 280 in a respective tip rail pocket 270. Each insert 280 is shaped and sized to complement a respective tip rail pocket 270, e.g., dimensions, curvature, etc. Further, tip rail pocket 270 and insert 280 may be configured such that end surface 288 of insert 280 is substantially planar with end surface 160 of tip rail 250. At least two of the plurality of tip rail pockets 270 may have the same geometric shape and dimensions, allowing for an insert 280 of a particular shape and size to be used for a number of tip rail pockets 270.

Alternatively, each insert and pocket combination can be customized for a particular location on the tip rail.

As shown in FIG. 9, coolant collection plenum 284 in insert 280 is fluidly connected to internal cooling cavity(ies) 174, e.g., by blade cooling channel(s) 272 extending from internal cooling cavity(ies) 174 to at least one tip rail pocket coolant opening 290 (see FIGS. 5, 6 and 10) in tip rail pocket 270. While tip rail pocket coolant openings 290 are shown in a bottom of tip rail pocket 270, they may be in any location allowing fluid communication with coolant collection plenum 284. Coolant collection plenum 284 is shown extending the majority of a length of inserts 280 in many of the embodiments illustrated herein. It is recognized, however, that such positioning may not be necessary in all instances, and plenum 284 can take a variety of forms, see e.g., FIG. 20.

In one embodiment, as shown for example in FIGS. 7 and 8, insert 280 is a monolithic structure. In this case, insert 280 includes a body 294 having insert cooling channel(s) 282 and coolant collection plenum 284 formed therein. Insert 280 can be made by providing a block of material and machining channels 282 and plenum 284 therein. Alternatively, insert 280 can be additively manufactured. Insert 280 can include a superalloy. As used herein, "superalloy" refers to an alloy having numerous excellent physical characteristics compared to conventional alloys, such as but not limited to high mechanical strength and high thermal creep deformation resistance. Examples of superalloys include N400 or N500, Rene 108, CM247, Haynes alloys, Incalloy, MP98T, TMS alloys, and CMSX single crystal alloys. In one embodiment, superalloys for which teachings of the disclosure may be especially advantageous are those superalloys having a high gamma prime (γ') value. "Gamma prime" (γ') is the primary strengthening phase in nickel-based alloys. Example high gamma prime superalloys include but are not limited to: Rene 108, N5, GTD 444, MarM 247 and IN 738.

Figure 12:
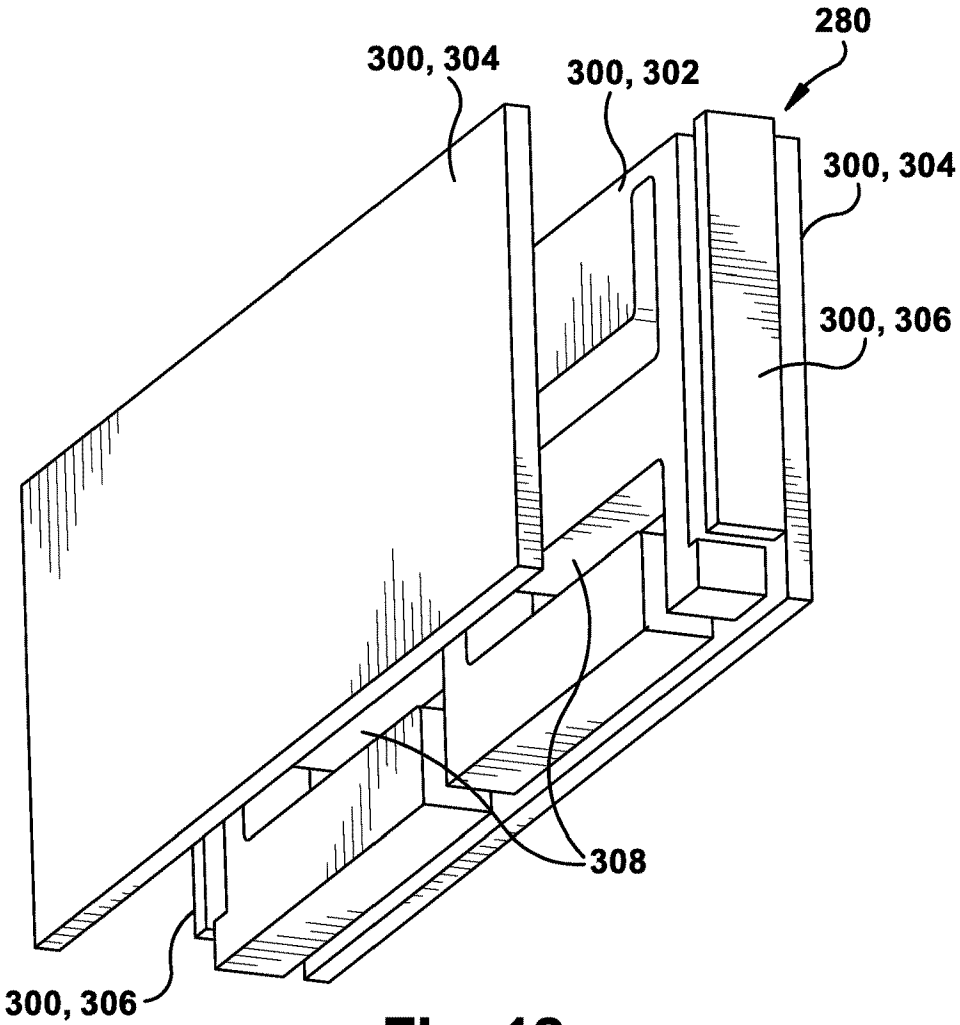
FIG. 12 is an exploded perspective view of the tip rail cooling insert of FIG. 11.
Figure 11:
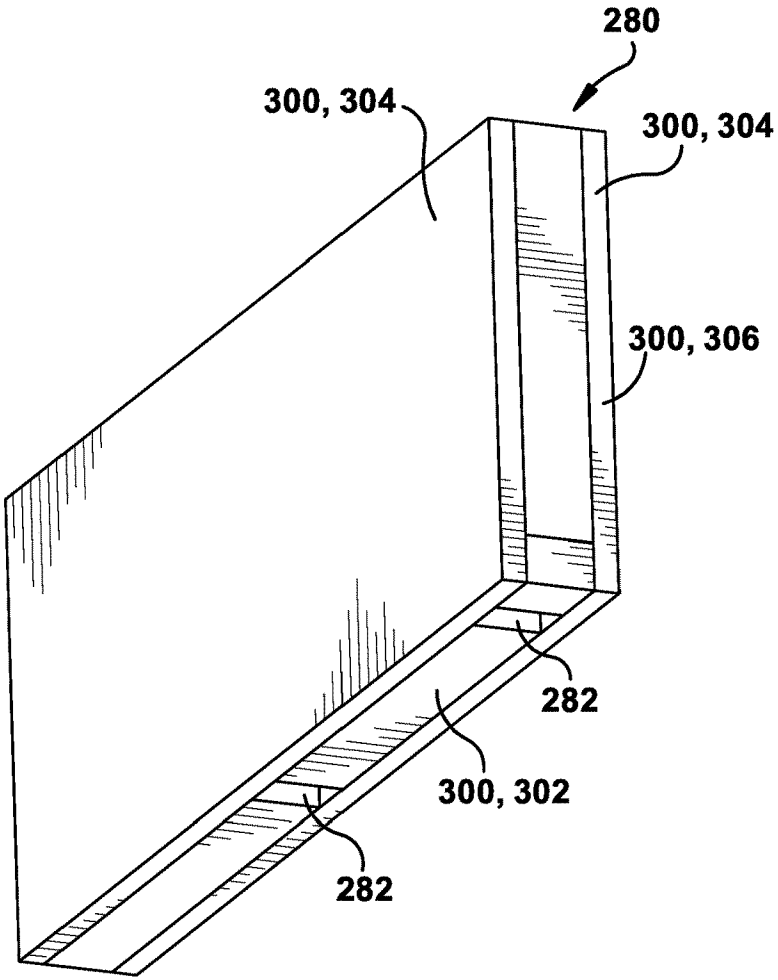
FIG. 11 is a perspective view of a tip rail cooling insert, according to embodiments of the disclosure.

In another embodiment, as shown for example in the perspective view of FIG. 11 and the related, partially exploded perspective view of FIG. 12, tip rail cooling insert 280 may include a laminated plurality of material layers 300. That is, insert 280 is formed by laminating plurality of material layers 300. For example, an inner layer (body) 302 may include an open coolant path region 308 defining cooling channel(s) 282 therein. Inner layer 302 can be sandwiched between a pair of outer layers 304 to form cooling channel(s) 282. That is, forming insert 280 includes providing inner layer 302 having open coolant path region 308 therein and sandwiching inner layer 302 between adjacent outer layers 304 to form insert cooling channel(s) 282 from open coolant path region 308. Inner layer 302 can include any number of pieces, e.g., one or more. A pair of end cap layers 306 may also be used, where necessary or desired, to encase ends of inner layer 302. Inner layer 302 may include, for example, a superalloy, and one or more of the material layers 300, e.g., outer layers 304, 306, may include a pre-sintered preform (PSP) material layer.

Returning to FIGS. 9 and 10, attaching insert 280 to tip rail pocket 270 fluidly connects coolant collection plenum 284 to internal cooling cavity(ies) 174, such that coolant can flow through plenum 284 to cooling channel(s) 282 to cool tip rail 250. Coolant can exit through exit apertures(s) 286 (FIG. 9). In one embodiment, tip rail cooling insert 280 is attached to tip rail pocket 270 by brazing insert 280 to the pocket 270. Here, coolant collection plenum 284 can act as a brazing receptacle for excess brazing, preventing accidental filling of tip rail pocket coolant opening(s) 290 in tip rail pocket 270. Where PSP is employed, attaching insert 280 may include brazing and/or heating the PSP material layer(s). In this fashion, the PSP material layers may soften, allowing easy installation, followed by strong adherence in pocket 270 upon cooling. Any now known or later developed manufacturing techniques may be additionally applied where necessary to couple insert 280 into pocket 270, e.g., heat application to ease insertion, etc.

Figure 13:
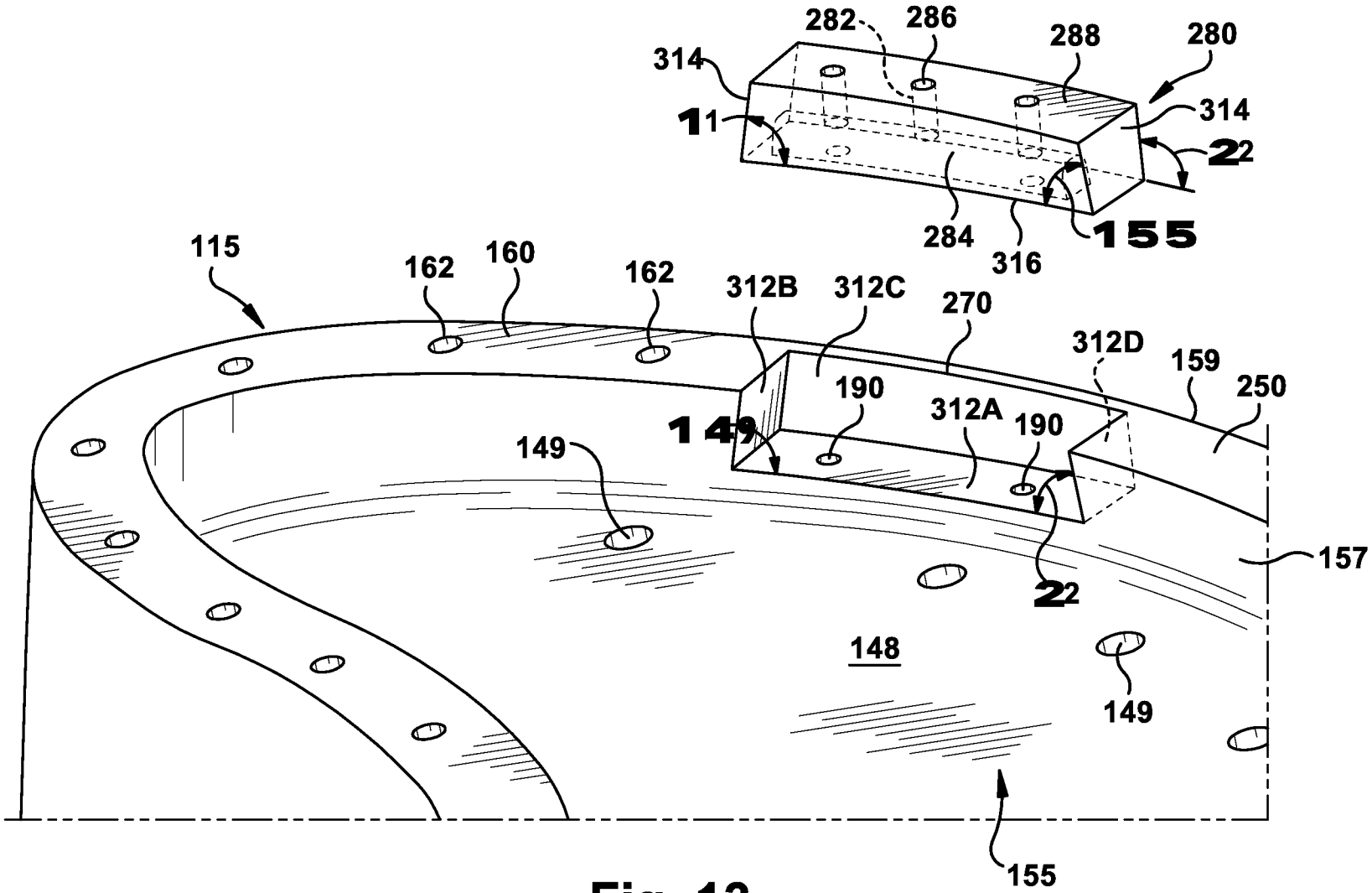
FIG. 13 is an exploded perspective view of a tip rail pocket and a tip rail cooling insert, according to embodiments of the disclosure.

Referring again to FIG. 6, and additionally to the perspective view of FIG. 13, illustrative shapes of tip rail pocket 270 and insert 280 will be described. Generally, tip rail pocket 270 can have any shape desired to accommodate a corresponding insert 280 shape and size. In the embodiments described, tip rail pocket 270 is open to end surface 160, such that insert 280, i.e., an end surface 288 thereof, can fill the void in end surface 160 of tip rail 250. In some embodiments, tip rail pocket 270 and insert 280 may be complementarily curved along their length and/or height and/or width, but this is not necessary in all instances. Dimensions will vary depending on the size of tip rail 250. In one example, length of insert 280 and tip rail pocket 270 may be as small as 1 centimeter. In the FIGS. 5 and 6 embodiments, tip rail pocket 270 is formed with one open end 310 and with five surfaces 312A-E. Each surface 312A-E is configured to match an outer side of insert 280. However, tip rail pocket 270 can have a variety of other shapes.

Figure 14:
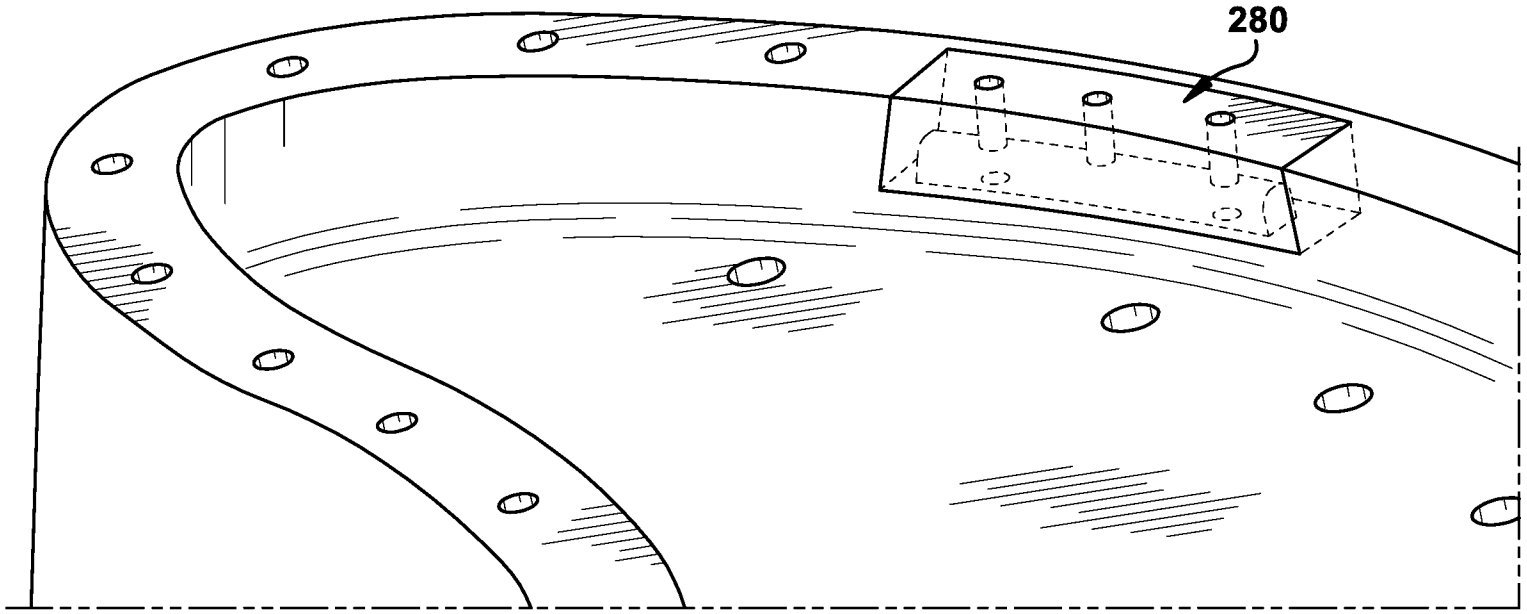
FIG. 14 is a perspective view of the tip rail cooling insert in the tip rail pocket of FIG. 13.

In one embodiment, as shown in FIG. 13, tip rail pocket 270 can be formed to include at least four surfaces 312A-D for engaging insert 280. Here, an inner wall of tip rail 250, i.e., the one providing inner rail surface 157, is removed. Surfaces 312B and 312D can be angled inwardly (see angles $\alpha 1$ and $\alpha 2$) relative to surface 312A. An insert 280 can be shaped to complement tip rail pocket 270, i.e., with angled side walls 314 at $\alpha 1$ and $\alpha 2$ relative to a bottom 316 of insert 280. As shown in FIG. 14, insert 280 can be slid into place from tip cavity 155. In this manner, insert 280 is radially locked in place by the angled surfaces 312B, 312D and walls 314 and can be brazed into place to prevent its movement out of pocket 270. In this setting, insert 280 also provides a missing part of inner rail surface 157, i.e., it completes the surface 157. As one with skill in the art will recognized, tip rail pocket 270 and insert 280 can be formed into a variety of alternative complementary shapes other than those described herein, all of which are considered within the scope of the disclosure.

Figures 15, 16:
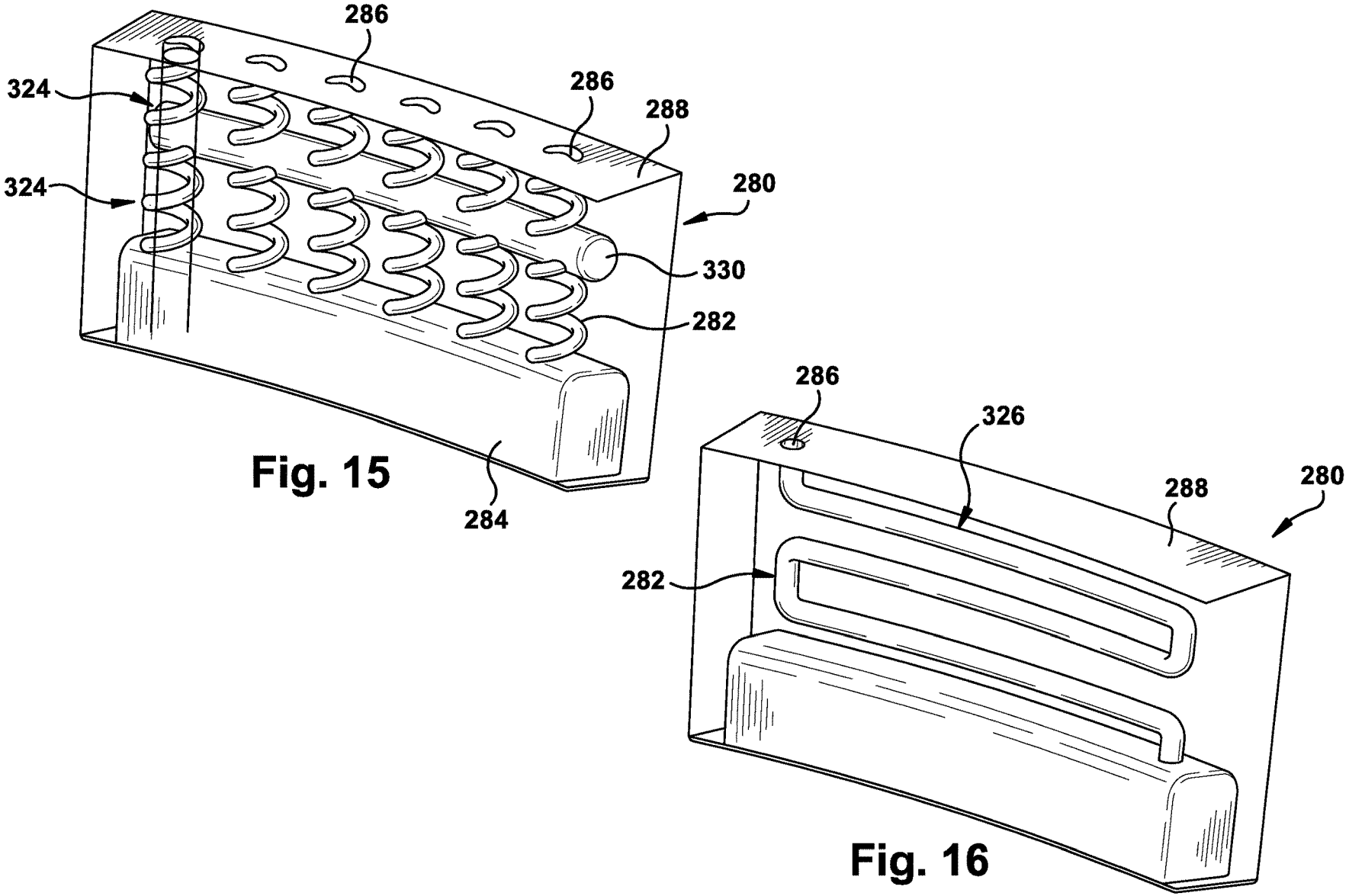
FIG. 15 is a perspective view of a tip rail cooling insert, according to embodiments of the disclosure.
FIG. 16 is a perspective view of a tip rail cooling insert in a tip rail, according to embodiments of the disclosure.
Figure 17:
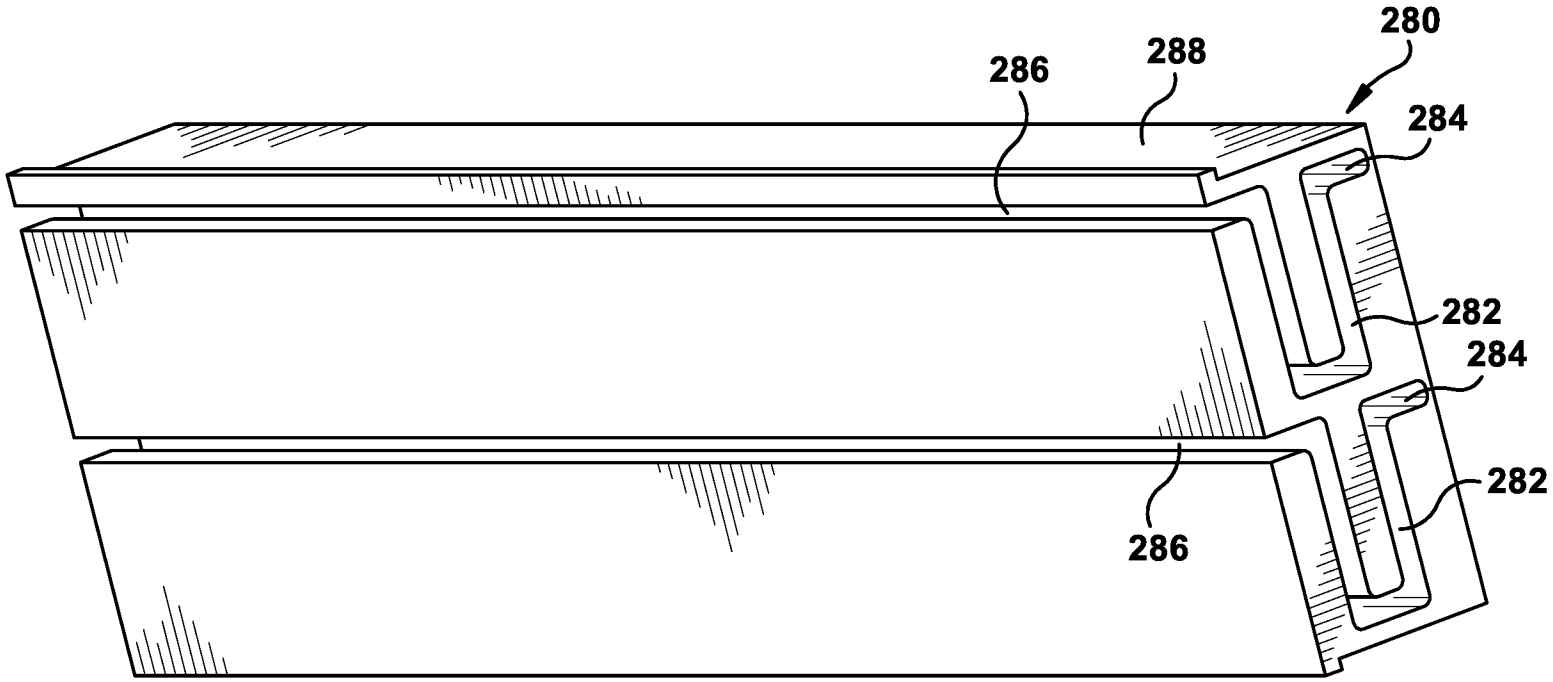
FIG. 17 is a perspective view of a tip rail cooling insert, according to embodiments of the disclosure.

Referring to FIGS. 7-9, 13, and 15-22, insert cooling channel(s) 282 can take any of a large variety of paths through insert 280. FIG. 7 shows insert cooling channel(s) 282 including a pair of channels 320 extending in a squared off sinusoidal pattern, with each coupled to plenum 284 and each having their own exit aperture 286. FIG. 8 shows insert cooling channel(s) 282 extending in a crossing pattern from plenum 284 to create a lattice configuration 322. This arrangement has a large number of exit apertures 286 and may or may not have channels 282 fluidly intersect, i.e., where they come in close proximity along their lengths. FIG. 13 shows insert cooling channel(s) 282 simply extending radially from plenum 284. FIG. 15 shows insert cooling channel(s) 282 extending from plenum 284 in a helical pattern 324. Each channel 282 in FIG. 15 has its own exit aperture 286, but this is not necessary in all instances. FIG. 15 also shows a mid-insert traversing channel 330 between coolant collection plenum 284 and at least one exit aperture 286. Mid-insert traversing channel 330 may interconnect two or more insert cooling channel(s) 282. While only shown in the FIG. 15 embodiment, it is recognized that mid-insert traversing channel 330 may be employed in any embodiment disclosed herein. FIG. 16 shows insert cooling channel 282 (only one long channel employed) extending in a rounded sinusoidal pattern 326. FIG. 17 shows an insert 280 of the type that would be used in a tip rail pocket 270 opening through inner rail surface 157, i.e., similar to FIGS. 13-14. Here, inner cooling channels 282 move in a pair of U-shaped patterns to elongated exit apertures 286 that face into tip cavity 155 (FIG. 4). Insert 280, as shown in FIG. 17, does not include angled side walls 314, like shown in FIG. 13, but it is understood such angled walls could be provided, if desired. Here, plenum 284 has delivery passages (not shown) extending through a back side of the insert.

Figure 18:
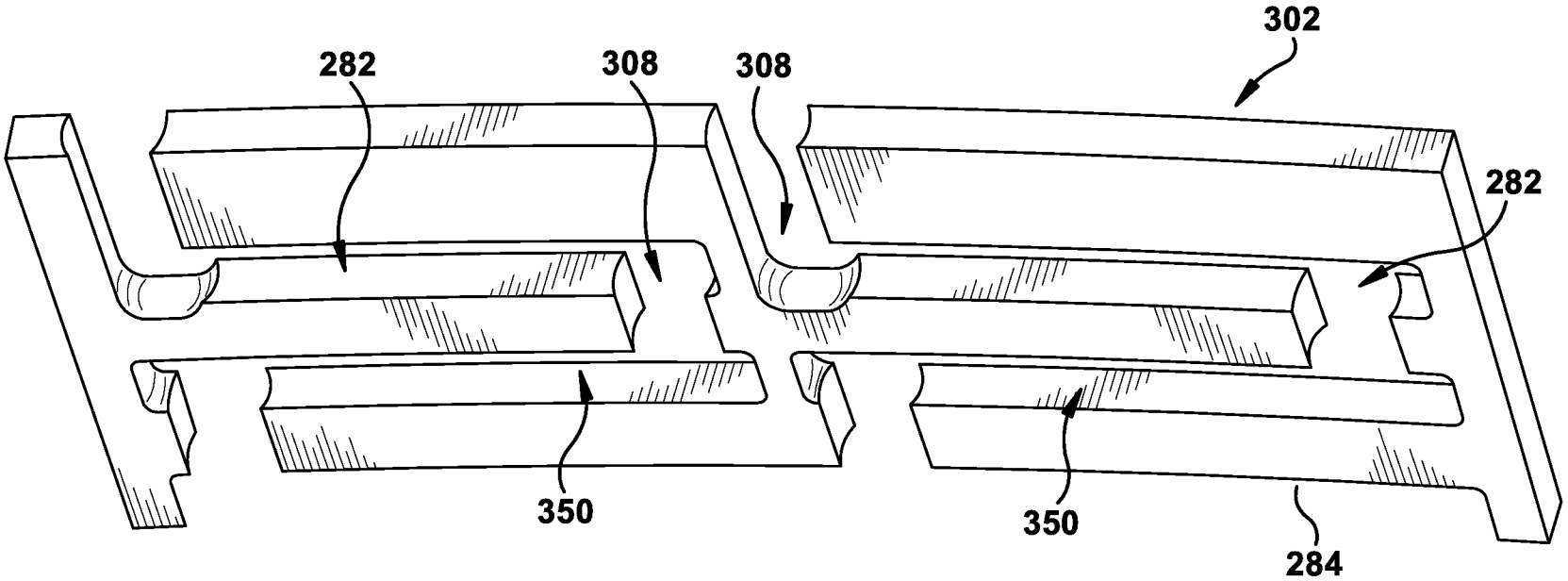
FIG. 18 is a perspective view of an inner layer of a tip rail cooling insert, according to embodiments of the disclosure.
Figure 19:
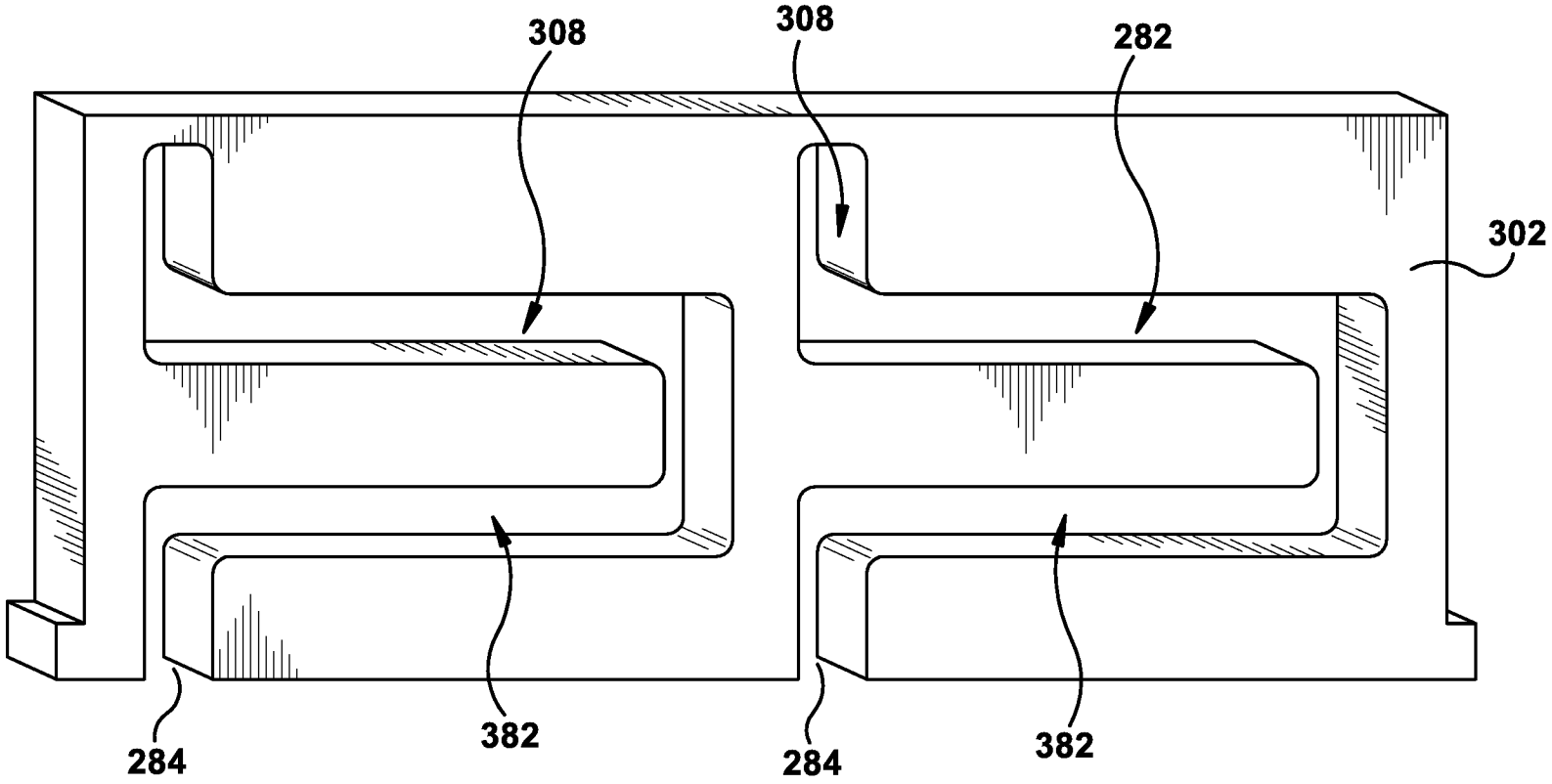
FIG. 19 is a perspective view of an inner layer of a tip rail cooling insert, according to embodiments of the disclosure.

FIGS. 18 and 19 show perspective views of alternative embodiments of an inner layer 302 for the laminated material layer embodiments (FIGS. 11-12) having a different open coolant path region 308 defining insert cooling channel(s) 282 therein. FIG. 18 shows a multi-part inner layer 302 defining a pair of serpentine pattern paths 350, and FIG. 19 shows a one-part inner layer 302 having a pair of serpentine pattern paths 352. It is emphasized that a large variety of alternative open coolant path regions are also possible. Each inner layer 302 can be sandwiched between outer layers 304 (FIG. 12) to form insert 280, as described herein.

While each different embodiment shows insert cooling channel(s) 282 in a particular pattern, it is understood that patterns from the different embodiments can be intermixed. For example, at least one of insert cooling channel(s) 282 in an insert 280 could have a serpentine pattern, a crossing pattern, or a helical pattern, and at least one other could have one of the other patterns. Some of the inserts 280 described herein must be additively manufactured; however, others can be formed using casting or a material removing technique, perhaps with electro-discharge machining (EDM), wire EDM and/or laser cutting to create certain features, e.g., channels 282, plenum 284, etc. While particular examples of insert cooling channel(s) 282 have been illustrated herein, it is understood that others are possible and considered within the scope of the disclosure. Any of the variety of cooling channel arrangements described herein or otherwise available can include adaptive cooling channels, i.e., those allowing opening of other cooling channels when one is destroyed or clogged. In this fashion, insert cooling channel(s) 282 can form redistribution manifolds interconnecting any of a variety of branch cooling circuits for continued cooling operation during rubs that remove tip rail material or clog indiscriminate upper channels and/or exit apertures 286.

Figure 20:
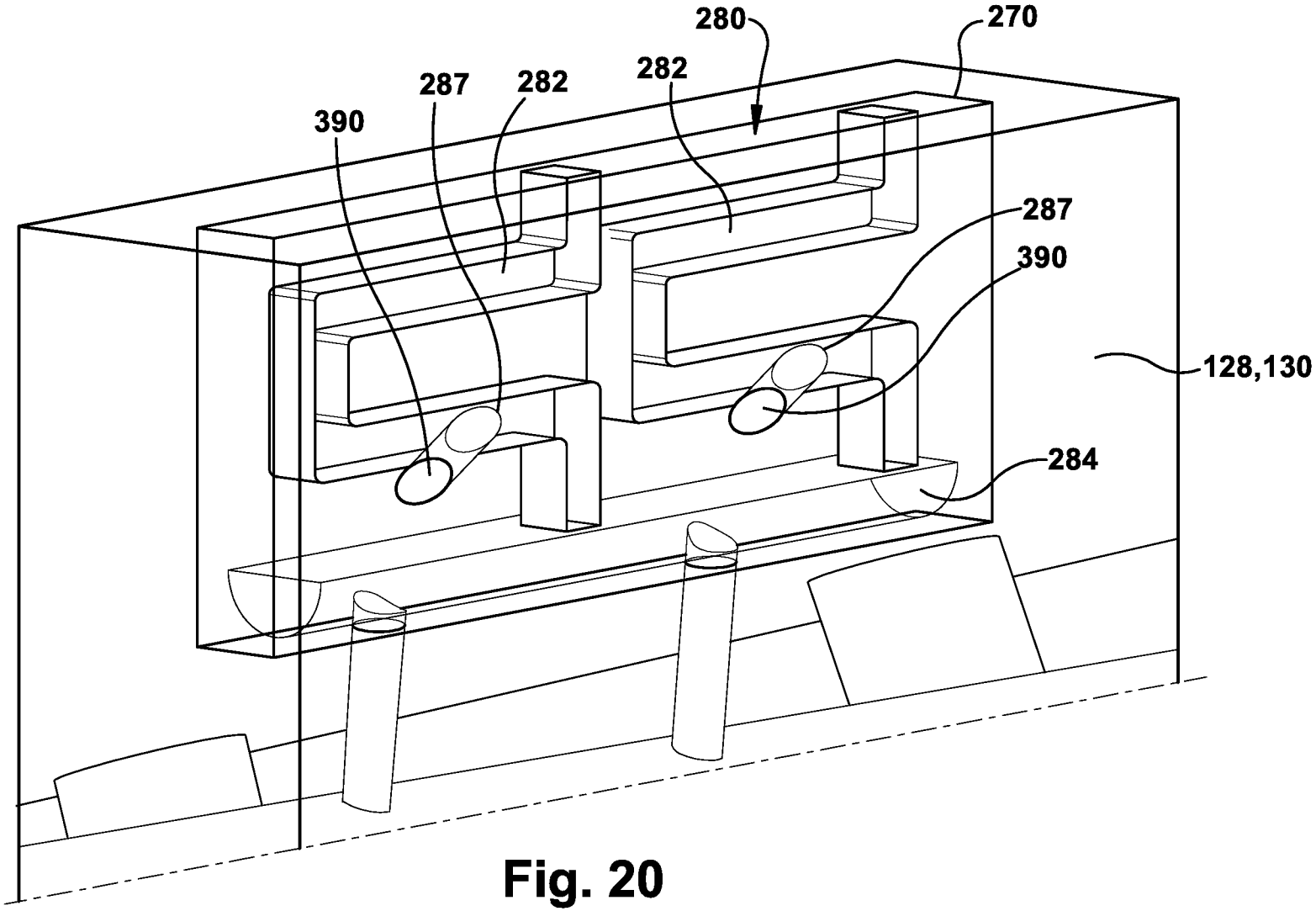
FIG. 20 is a perspective view of a tip rail cooling insert including side exit apertures, according to embodiments of the disclosure.

FIG. 20 is a perspective view of a tip rail cooling insert 280 in a tip rail pocket 270 including one or more side exit apertures 287, according to embodiments of the disclosure. In this embodiment, insert cooling channel(s) 282 are shown as serpentine. It is emphasized, however, that they can take any form described herein. In this embodiment, rather than exiting from end surface 288 (e.g., FIGS. 7-8), insert cooling channel(s) 282 include at least one coolant side exit aperture 287 in a side surface of the respective tip rail cooling insert 280. Here, coolant from insert cooling channel(s) 282 can exit via side exit apertures 287 to a side of tip rail cooling insert 280, i.e., a surface that faces against tip rail pocket 270 or into tip cavity 155 (as would be provided in FIG. 13). Side exit apertures 287 may be open to tip cavity 155 (e.g., when used in FIG. 13 embodiment), or may be closed off against an inside surface (e.g., 312C in FIG. 13) of tip rail pocket 270 to be opened as part of an adaptive cooling regime.

Alternatively, an exterior coolant passage 390 can be provided from an exterior surface of tip rail 250, e.g., from concave pressure side wall 128 or convex suction side wall 130, to side exit apertures 287 to allow for a cooling film to be created on, for example, side walls 128, 130. That is, a cooling film can be provided to side walls 128, 130 from tip rail cooling insert 280. Exterior coolant passage 390 may also pass through inner rail surface 157 of tip rail 250 to exit to tip cavity 155, if desired.

Side exit apertures 287 may be formed as part of tip rail cooling insert 280, e.g., during additive manufacture thereof. Alternatively, side exit apertures 287 can be formed with exterior coolant passage 390 by, for example, drilling from an exterior surface of tip rail cooling insert 280 into insert cooling channel(s) 180, or drilling from an exterior surface of tip rail 250 such as a side wall 128 or 130 through the side wall and into insert cooling channel(s) 282 (shown in FIG. 20) and/or coolant collection plenum 284. Any number of side exit apertures 287 (with or without exterior coolant passages 390) can be provided. In this manner, the cooling film can be provided, where necessary.

Figure 24:
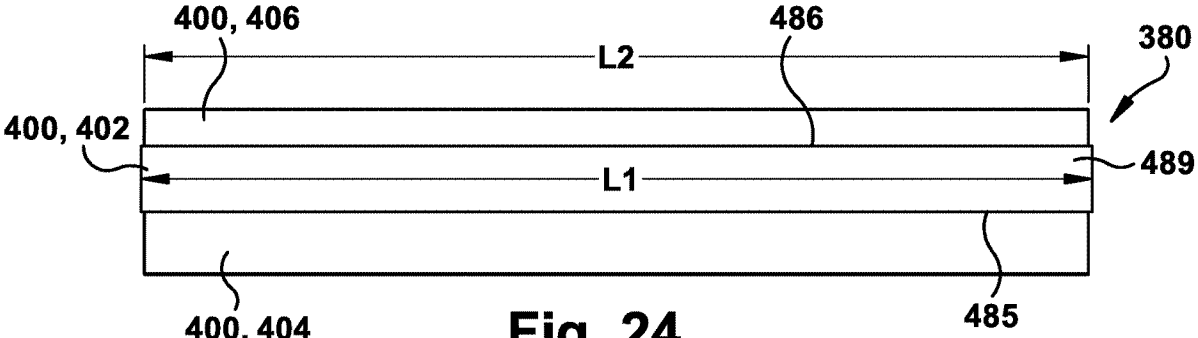
FIG. 24 is a plan view of a tip rail cooling insert, according to other embodiments of the disclosure.
Figure 21:
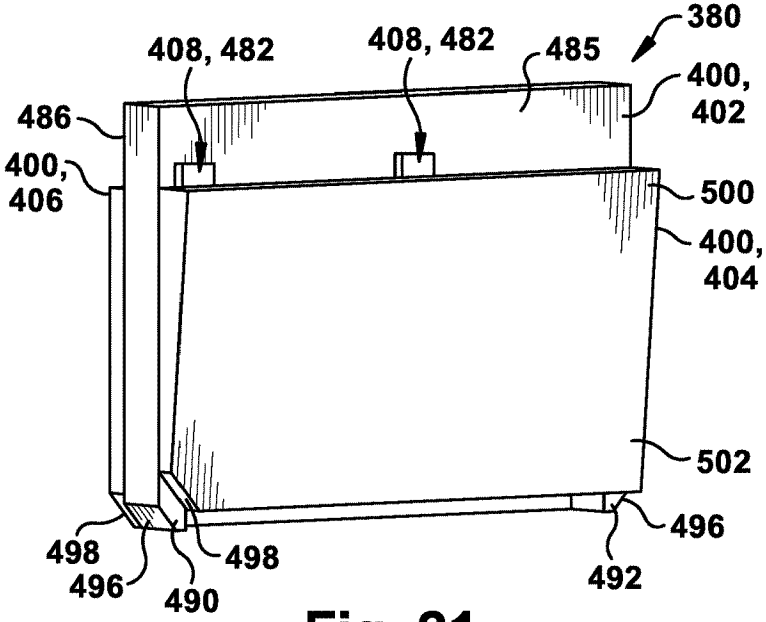
FIG. 21 is a perspective view of a tip rail cooling insert, according to other embodiments of the disclosure.
Figure 23:
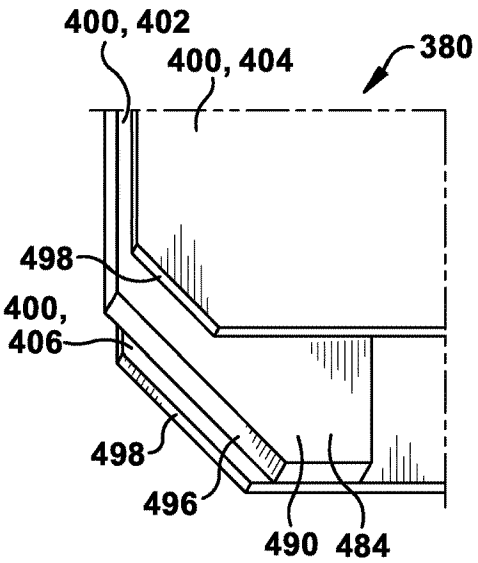
FIG. 23 is a side view of a tip rail cooling insert, according to other embodiments of the disclosure.
Figure 22:
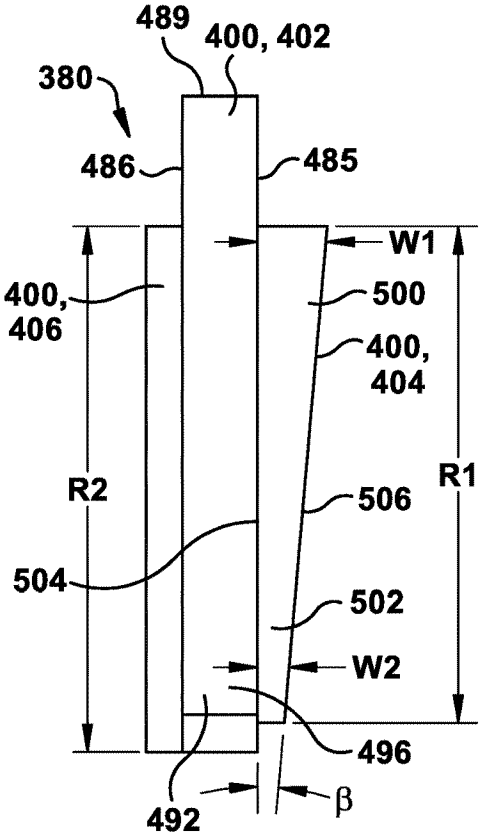
FIG. 22 is an end view of a tip rail cooling insert, according to other embodiments of the disclosure.

Referring to FIGS. 21-32, a tip rail cooling insert according to other embodiments are illustrated. A tip rail cooling insert 380 (hereinafter "insert 380") illustrated in FIGS. 21-32 is similar to insert 280 described relative to FIGS. 11, 12, 18 and 19, except it includes a number of additional or alternative features. FIG. 21 is a perspective view, FIG. 22 is a side view, FIG. 23 is an enlarged partial side view, and FIG. 24 is plan view, of insert 380. In these embodiments, as shown for example in the perspective view of FIG. 21 and the side view of FIG. 22, insert 380 may include a laminated plurality of material layers 400, similar to that shown and described relative to FIGS. 11 and 12. That is, insert 380 is formed by laminating plurality of material layers 400.

Figure 25:
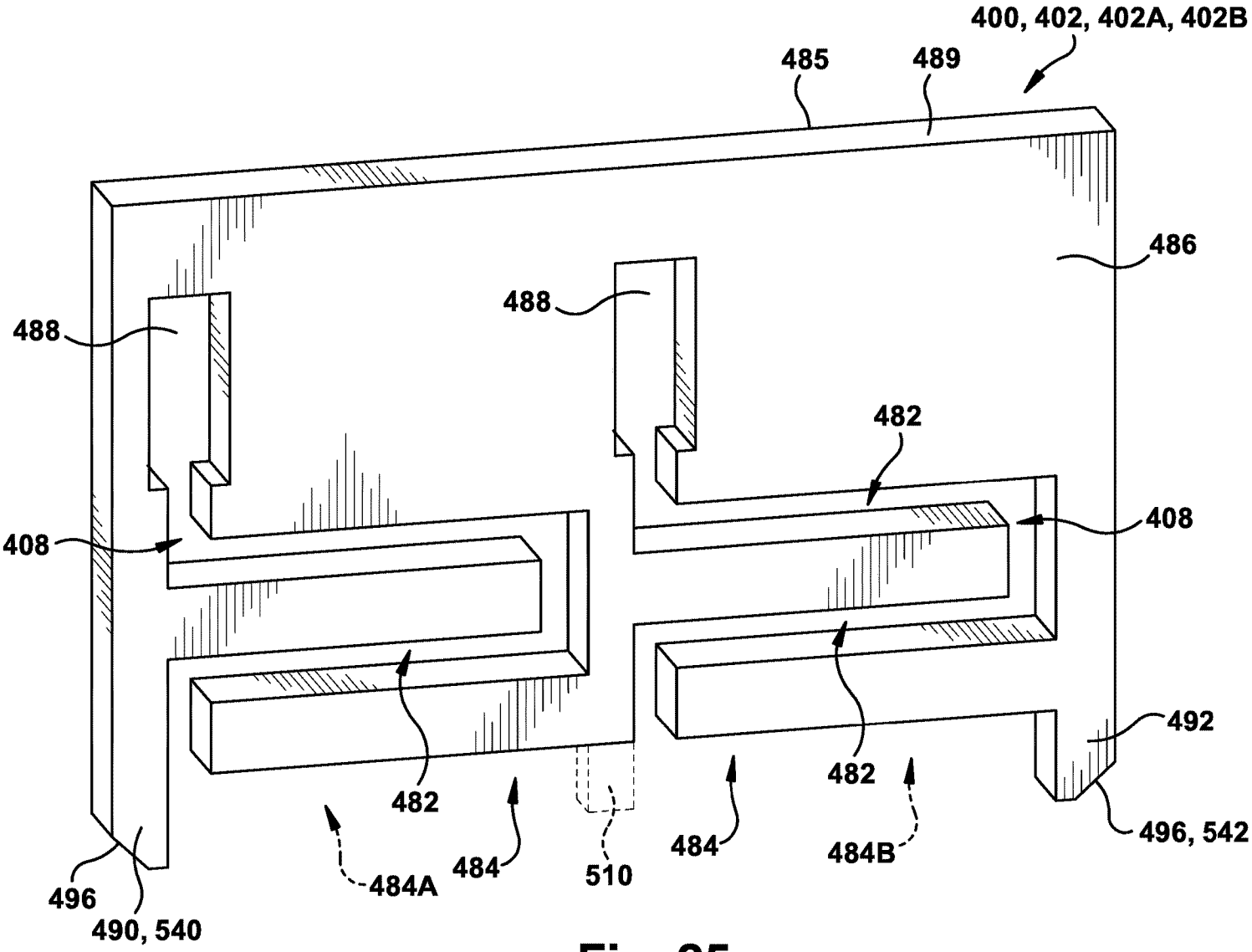
FIG. 25 is a perspective view of an inner layer of a tip rail cooling insert, according to other embodiments of the disclosure.

In one embodiment, insert 380 may include (first) inner layer 402 that acts as a central body for insert 380 and defines at least one first insert cooling channel 482 (FIG. 25) therein, e.g., using an open coolant path region 408 (FIG. 25). Insert cooling channel(s) 482 may be formed using any previously described methods for channel(s) 382, e.g., wire EDM, additive manufacture, etc. Insert 380 may also include a first outer layer 404 on a first side 485 of first inner layer 402; and a second outer layer 406 on a second side 486 of inner layer 402.

FIG. 25 shows a perspective view of an illustrative inner layer 402. Inner layer 402 may include an open coolant path region 408 defining insert cooling channel(s) 482 therein. Insert cooling channel(s) 482 can take a variety of paths through tip rail cooling insert 380 as illustrated and/or described herein relative to, for example, FIGS. 7-9, 13, 15, 16, 18 and/or 19. As will be described further herein, insert cooling channel(s) 482 may also include at least one radially outer chamber 488. Radially outer chamber 488 is shown as closed off from an (radially outer) end surface 489 of inner layer 402. As will be described herein, eventually, one or more of insert cooling channels 482 may exit through at least one coolant exit aperture 522 (FIG. 31) opened in radially outer chamber 488 (FIG. 25) and extending through end surface 489 of a respective insert 380.

Inner layer 402 can be sandwiched between outer layers 404, 406 to form cooling channel(s) 482. That is, forming insert 380 includes providing inner layer 402 having open coolant path region 408 therein and sandwiching inner layer 402 between adjacent outer layers 404, 406 to form insert cooling channel(s) 482 from open coolant path region 408. Inner layer 402 can include any number of pieces, e.g., one or more. Inner layer 402 may include, for example, a superalloy as described herein. One or more of the material layers 400, e.g., outer layers 404, 406, may include a pre-sintered preform (PSP) material layer. Here, outer layer 404 may be a first pre-sintered preform (PSP) outer layer 404, and outer layer 406 may be a second PSP outer layer 406.

Figure 26:
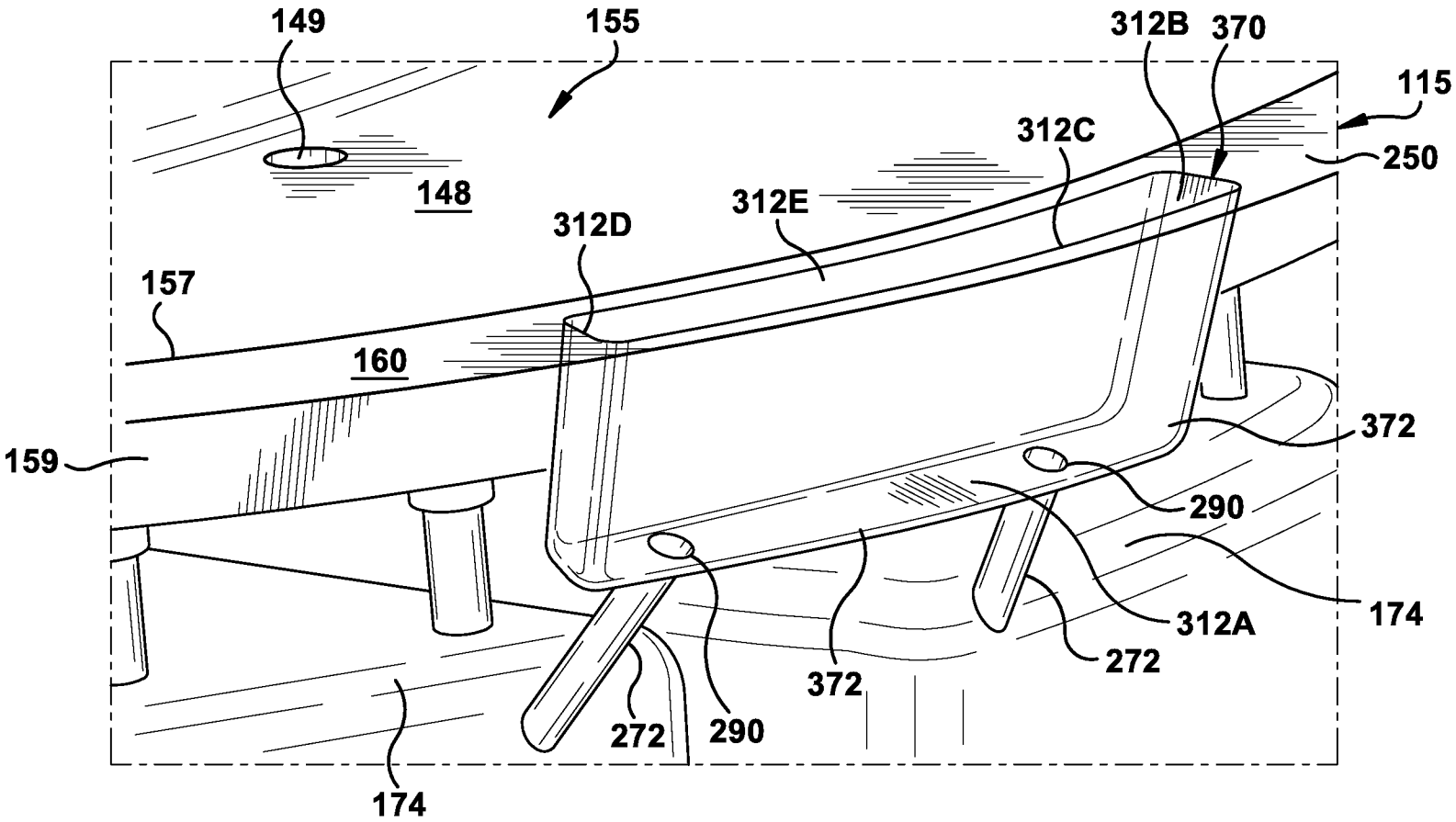
FIG. 26 is an enlarged, see-through perspective view of a tip rail pocket in a tip rail, according to other embodiments of the disclosure.
Figure 27:
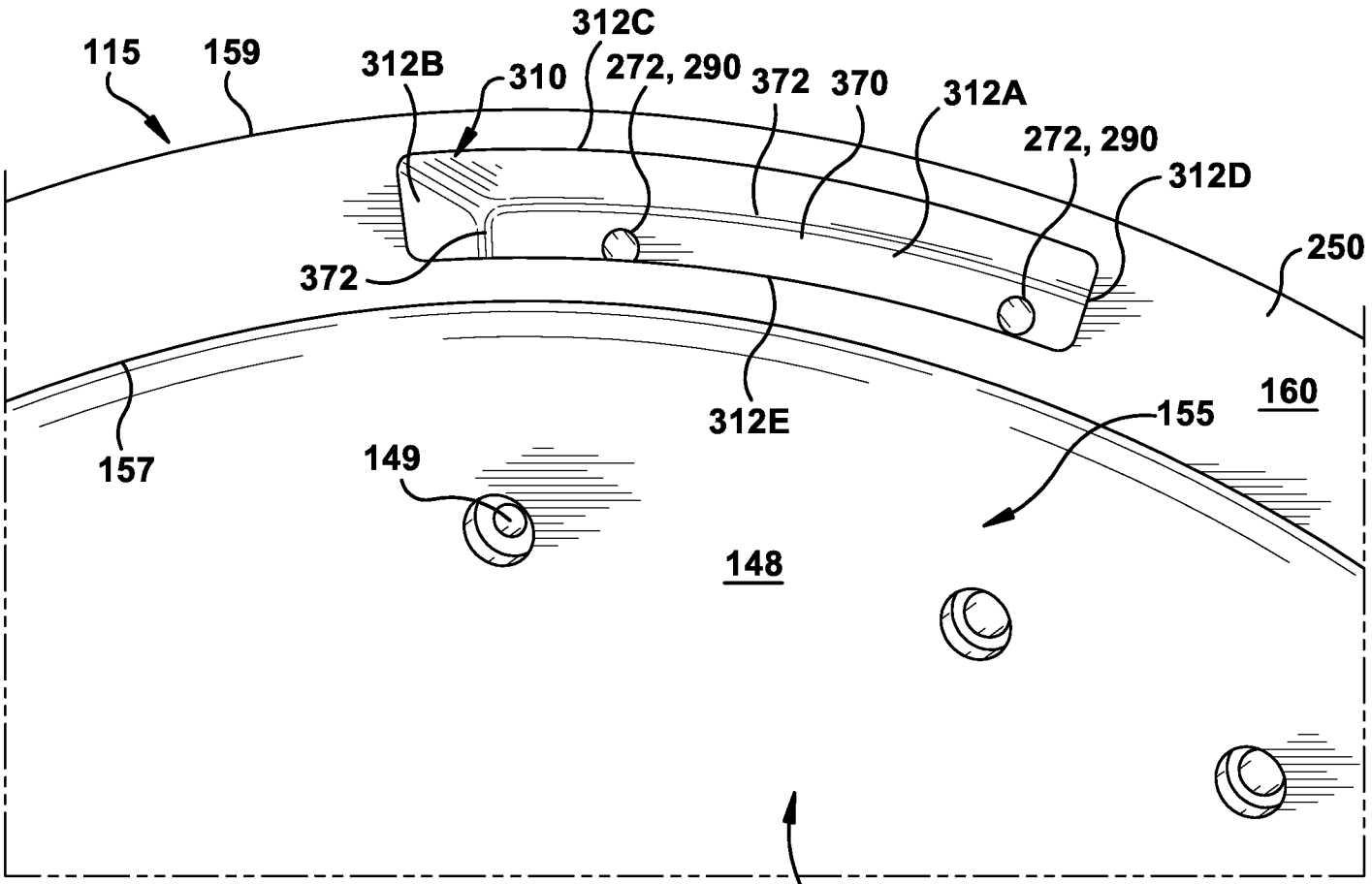
FIG. 27 is a plan view of a tip rail pocket in a tip rail, according to other embodiments of the disclosure.

FIG. 26 is an enlarged, see-through perspective view of a tip rail pocket 370 in tip rail 250, and FIG. 27 is a plan view of tip rail pocket 370 in tip rail 250, according to other embodiments of the disclosure. In these embodiments, tip rail pocket 370 is substantially similar to tip rail pocket 270, shown in FIGS. 5 and 6. Generally, tip rail pocket 370 can have any shape desired to accommodate a corresponding insert 380 shape and size. In the embodiments described, tip rail pocket 370 is open to end surface 160, such that insert 380 (FIGS. 21-24), i.e., an end surface 489 (FIG. 25) thereof, can fill the void in end surface 160 of tip rail 250. In some embodiments, tip rail pocket 370 and insert 380 may be complementarily curved along their length and/or height and/or width, but this is not necessary in all instances. Dimensions will vary depending on the size of tip rail 250. In one example, length of insert 380 and tip rail pocket 370 may be as small as 1 centimeter.

In the FIGS. 26 and 27 embodiments, tip rail pocket 370 is formed with one open end 310 and with five surfaces 312A-E. Each surface 312A-E is configured to match an outer side of insert 380. However, tip rail pocket 370 can have a variety of other shapes. In this embodiment, in contrast to FIGS. 5-6, tip rail pocket 370 includes rounded inner corners 372, i.e., similar to fillets. More particularly, as shown best in FIG. 27, surfaces 312B-E of tip rail pocket 370 meet at rounded corners 372 with an inner surface 312A rather than squared off corners, as shown in FIGS. 5-6.

As shown in FIGS. 21-23 and 25, inner layer 402 may include a pair of spaced legs 490, 492 for defining a coolant collection plenum 484 with at least tip rail pocket 370 (FIG. 26). Coolant collection plenum 484 directs coolant from at least one internal cooling cavity 174 (FIG. 26) in turbine blade 115 (FIG. 26) to insert cooling channel(s) 482 (FIG. 25). In contrast to the FIG. 18 embodiment, each of pair of spaced legs 490, 492 has an angled outer end 496 configured to accommodate rounded inner corners 372 of tip rail pocket 370. As shown in FIGS. 21-23, outer layers 404, 406 may also include angled outer ends 498, although this is not necessary in all instances. Angled outer ends 498 may be planar or curved to accommodate rounded corners 372 (FIG. 26). Legs 490, 492 with angled outer ends 496 provide a simplification of insert 380 and coolant collection plenum 484, allowing flow volume to be controlled, in part, by the height of legs 490, 492. Angled outer ends 496, 498 help to ensure true bottoming of insert 380 in tip rail pocket 370 with rounded corners 372. Angled outer ends 496, 498 are made slightly larger than a radius of rounded corners 372.

Referring again to FIG. 22, one of outer layers, e.g., layer 404, may have a first end 500 having a larger width W1 than a second end 502 (width W2), creating a wedge cross-sectional shape. In contrast, the other outer layer 406 may be substantially planar, creating a rectangular cross-sectional shape. Outer layer 404 having wedge cross-sectional shape may have a first surface 504 at an angle β to a second, opposing surface 506 thereof. Angle β may be, for example, between 3.5° and 6.5° and, in one particular example, may be approximately 5°. As shown in the perspective view of FIG. 28, inserting insert 380 into tip rail pocket 370 may include using the wedge cross-sectional shape of outer layer 404 to tighten outer layer 406 and inner layer 402 in tip rail pocket 370. As shown in a cross-sectional view of FIG. 29, tip rail pocket 370 may be similarly angled (angle (3') to mate with or accommodate wedge cross-sectional shape in a friction or interference fit that can be secured by, for example, brazing and/or heating outer layers 404, 406.

FIGS. 21-23 and 29 also show that outer layers 404, 406 (and also inner layer 402) may have different radial heights R1, R2, respectively. One or both outer layers 404, 406 may not contact inner surface 312A of tip rail pocket 370, i.e., R1 and/or R2 are not as long as tip rail pocket 370 is deep. As shown in FIG. 24, inner layer 402 may have a length L1 greater than a length L2 of each of outer layers 404, 406. Here, length is defined in a longitudinal direction of tip rail 250. The different lengths allow inner layer 402 to properly mate with tip rail pocket 370, e.g., to help ensure centering of insert 380 in tip rail pocket 370 without pinching or binding against rounded corners 372, and to maintain minimal length end gaps. The difference in lengths could be in one non-limiting example, approximately 0.5 millimeters.

In another embodiment, shown in phantom in FIG. 25, inner layer 402 may include an additional leg 510 extending to a corresponding surface, e.g., inner surface 312A (FIGS. 26-27) of tip rail pocket 370, in a spaced manner between pair of spaced legs 490, 492. As illustrated schematically in FIG. 25, additional leg 510 segments coolant collection plenum 484 into a pair of coolant collection plenums 484A, 484B (phantom lines). In any event, each coolant collection plenum 484 directs coolant from internal cooling cavity(ies) 174 (FIG. 26) in turbine blade 115 to a respective insert cooling channel 482 in insert 380. Any number of additional legs 510 may be employed to segment coolant collection plenum 484, as desired.

Referring to FIGS. 26-30, a method according to embodiments of the disclosure will be described. The method provides a process for forming a turbine blade tip cooling system 200 (FIG. 31) using insert 380. Additional or alternative features of insert 380 will become apparent from the disclosure of the method. In a first process according to embodiments of the method, as shown in FIGS. 26 and 27, tip rail pocket 370 may be formed in end surface 160 of tip rail 250 of turbine blade 115. As noted, turbine blade 115 may include tip cavity 155 with tip rail 250 surrounding least a portion of the tip cavity and internal cooling cavity(ies) 174 configured to deliver a coolant. In this embodiment, tip rail pocket 370 includes rounded inner corners 372 and tip rail pocket coolant opening(s) 290 in fluid communication with internal cooling cavity(ies) 174. Tip rail pocket 370 may be formed in a new blade or a used blade.

Figure 28:
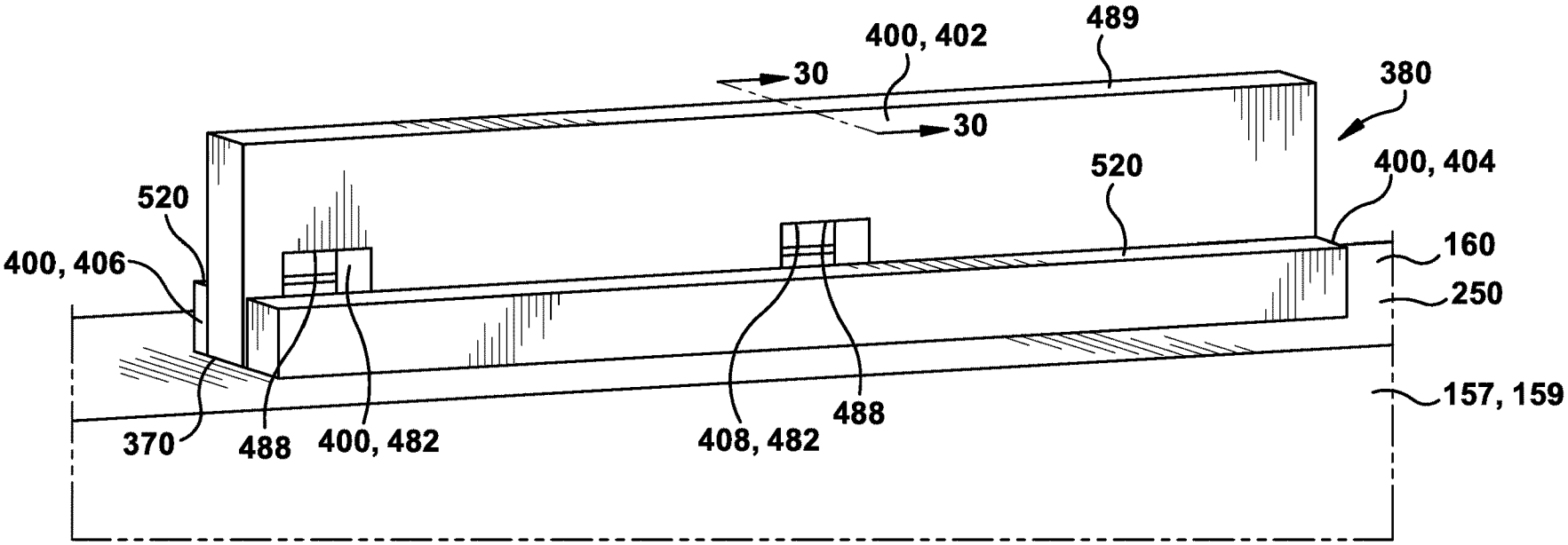
FIG. 28 is a perspective view of a tip rail cooling insert in an initially inserted position in a tip rail pocket, according to other embodiments of the disclosure.
Figure 29:
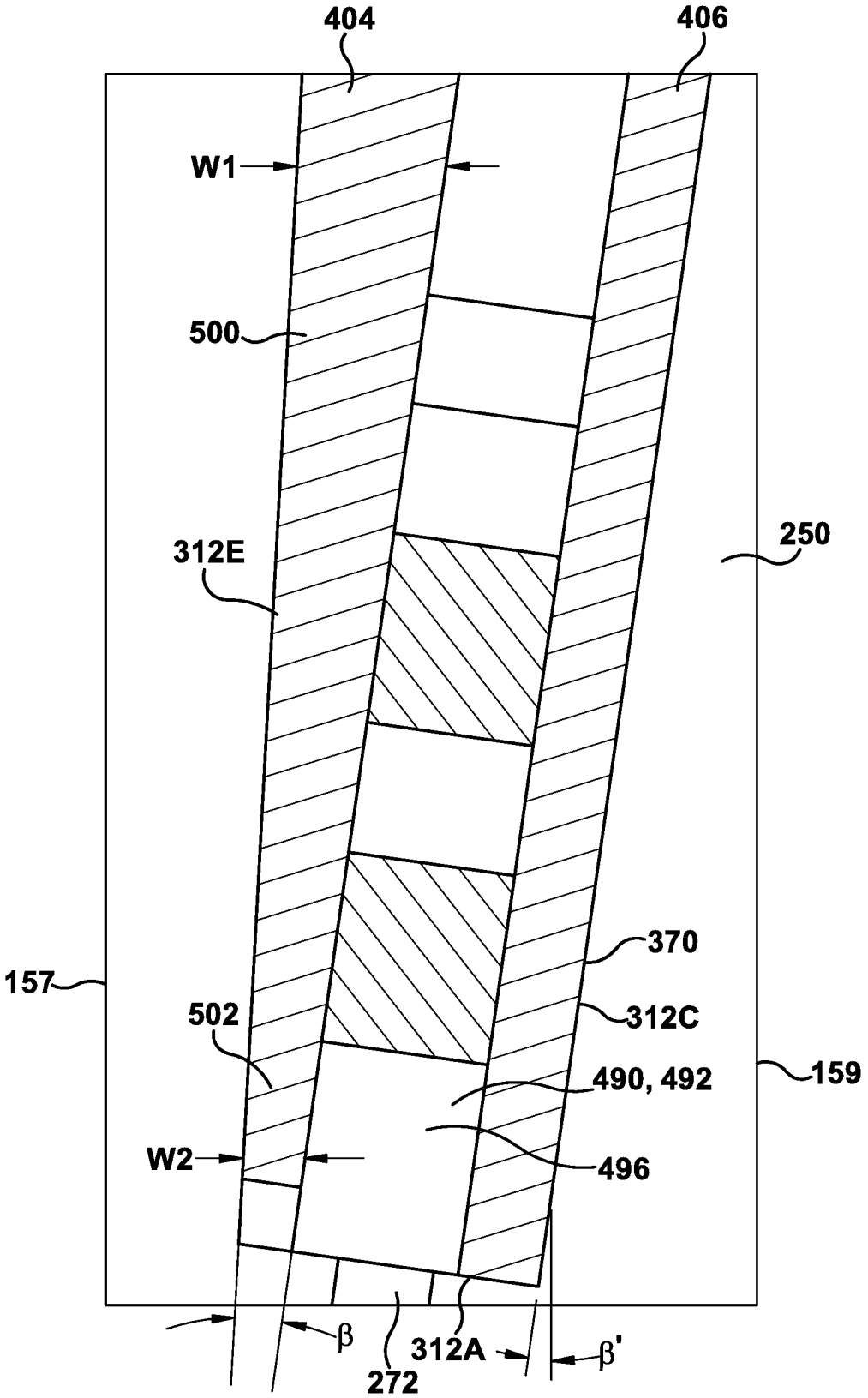
FIG. 29 is a cross-sectional end view of a tip rail cooling insert after planarizing and in a final inserted position in a tip rail pocket, according to other embodiments of the disclosure.

FIG. 28 shows a perspective view of inserting insert 380, as described herein, into a respective tip rail pocket 370 in tip rail 250. As noted, inner layer 402 defines insert cooling channel(s) 482 including radially outer chamber(s) 488. Radially outer chambers 488 may be wider than the rest of insert cooling channel(s) 482 and may extend radially. Outer layers 404, 406 sandwich inner layer 402 (i.e., inner layer 402 is directly between outer layers 404, 406). As shown in FIG. 28, in the initial insertion position of an insert 380 into a respective tip rail pocket 370, a portion of at least inner layer 402 may extend outwardly from tip rail pocket 370. In some cases, outer layers 404, 406 may also extend outwardly from tip rail pocket 370. In any event, radially outer chamber(s) 488 of inner layer 402 may extend above radially outer surface(s) 520 of first and/or second outer layers 404, 406. In this setting, radially outer chamber(s) 488 may act as a depth gauge to ensure insert 380 is properly seated in tip rail pocket 370. For example, radially outer chamber(s) 488 can be configured to have specified dimension of exposed opening above radially outer surface(s) 520 of one or more of outer layers 404, 406. In this regard, after the inserting of insert 380 into tip rail pocket 370, the method may include confirming a desired depth of insert 380 into tip rail pocket 370 based on a position of radially outer chamber(s) 488 relative to at least one of a radially outer surfaces 520 of at least one of outer layers 404, 406 and end surface 160 of tip rail 250.

Figure 31:
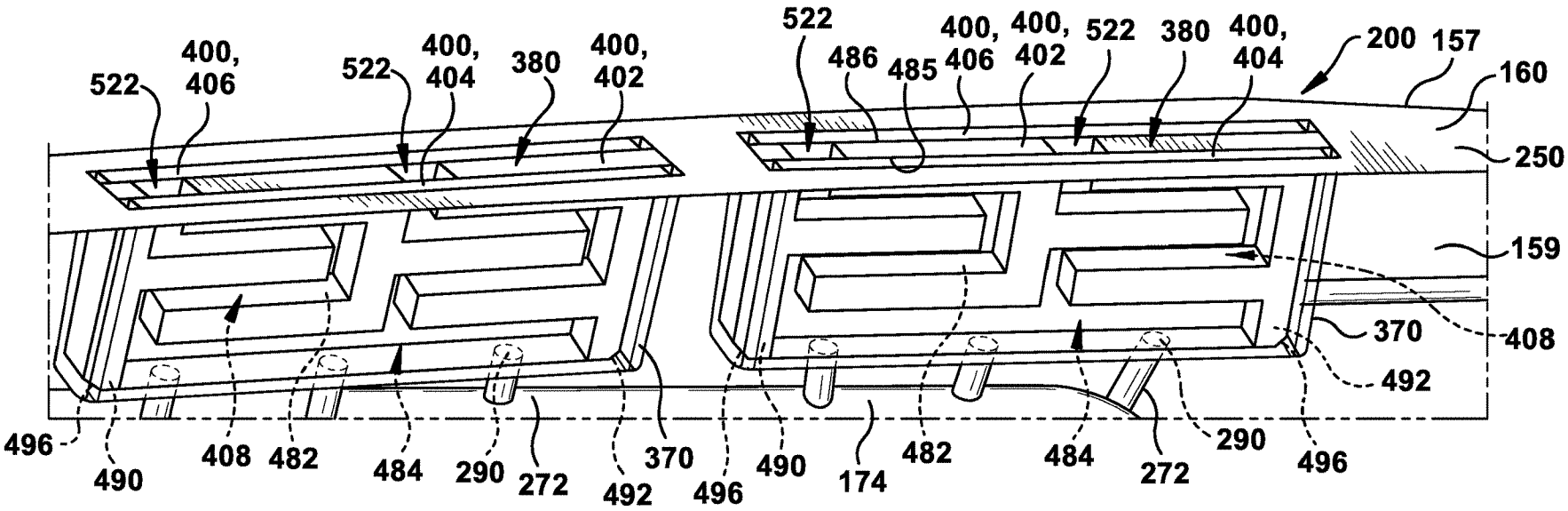
FIG. 31 is a perspective view of a tip rail cooling system including a tip rail cooling insert, according to other embodiments of the disclosure.

Once inserted, as shown best in FIG. 31, inner layer 402 (more permanently) defines insert cooling channel(s) 482 therein. Pair of spaced legs 490, 492 (FIG. 25) (perhaps with additional legs 510) defines coolant collection plenum 484 for directing coolant from internal cooling cavity(ies) 174 (FIG. 26-27) to insert cooling channel(s) 482. Each of pair of spaced legs 490, 492 has an angled outer end 496 configured to accommodate rounded inner corners 372 (FIGS. 26-27 only for clarity) of a respective tip rail pocket 370. Outer layer 404 is on first side 485 of inner layer 402, and outer layer 406 is on second side 486 of inner layer 402. The insertion may include using the wedge cross-sectional shape of outer layer 404 to tighten outer layer 406 and inner layer 402 in tip rail pocket 402. In one non-limiting example, planar outer layer 406 may be inserted first with or followed by inner layer 402. In this manner, outer layer 406 and inner layer 402 are ensured to contact a bottom of tip rail pocket 370. Subsequently, wedge-shaped outer layer 404 may be inserted to tighten the layers and create tight gaps for brazing.

Figure 30:
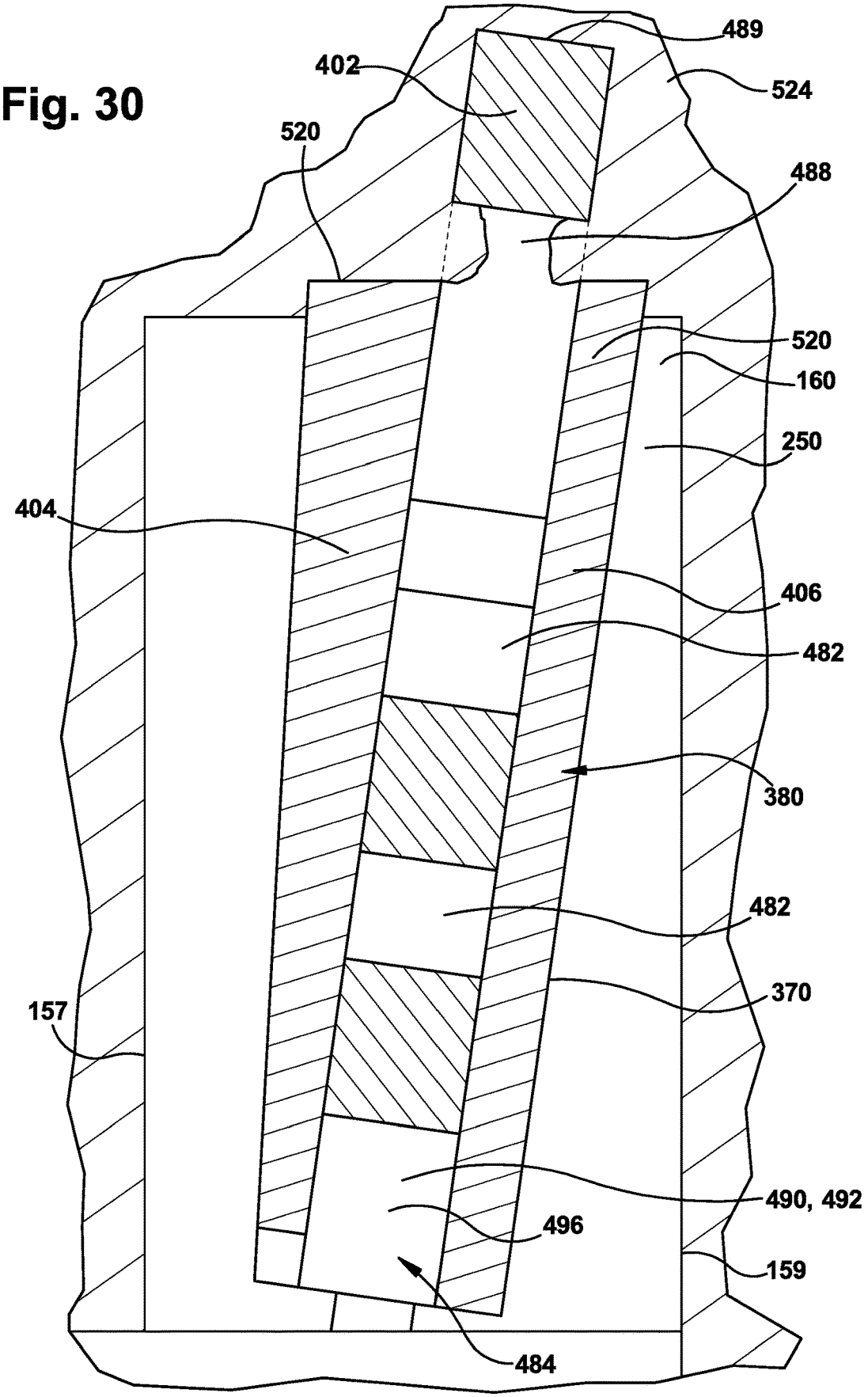
FIG. 30 is a cross-sectional view along view line 30-30 in FIG. 28 of a tip rail cooling insert in an initially inserted position in a tip rail pocket and with a coating applied thereto, according to other embodiments of the disclosure.

FIG. 30 shows an optional process of applying a coating 524 to tip rail 250 with radially outer chamber 488 collecting any excess coating. This process may occur after inserting insert 380 into tip rail pocket 370. Coating 524 may be applied using any now known or later developed process such as, but not limited to, a thermal spray process. Coating 524 may include any now known or later developed coating such as, but not limited to: paint, thermal barrier coating, environmental protection coating, etc. As illustrated in FIG. 30, radially outer chamber 488 and, in particular, where radially outer chamber 488 is exposed above outer layer 404, 406, outer radial surface 520 may collect excess coating 524 (e.g., by forming a capillary action stop). The collection of coating 524 may aid in ensuring an even coating, may prevent the eventually formed exit apertures 522 (FIG. 31) from clogging, and may prevent damage in subsequent processing to planarize insert 380.

FIG. 31 shows planarizing end surface 160 of tip rail 250 and insert 380, after the insertion. The planarizing may include any now known or later developed machining to remove excess material from insert 380 and tip rail 250 such as, but not limited to: wire EDM, grinding, laser cutting, etc. The planarization also creates a final insertion position of insert 380 into tip rail pocket 370. As shown in FIG. 31, the planarizing creates a radially open coolant exit aperture(s) 522 from insert cooling circuit(s) 482 and, in particular, from radially outer chamber 488 (FIG. 25). The planarizing also makes radially outer surface 520 of outer layers 404, 406 and radial outer surface 489 of inner layer 402 substantially coplanar with end surface 160 of tip rail 250. That is, inner layer 402 defines insert cooling channel(s) 482 including radially outer chamber 488, and the planarizing removes a portion of inner layer 402 that closes radially outer chamber 488, so that it is now radially open, thereby creating radially open coolant exit apertures(s) 522 in radial outer surface 489 of inner layer 402. Radially outer chamber(s) 488 provides coolant exit aperture(s) 522 that are larger than insert cooling channel(s) 482, and thus may assist in prevent clogging by dust from tip rubbing during use.

FIG. 31 also shows securing insert 380 to tip rail pocket 370 to (permanently) fluidly connect coolant collection plenum 484 to internal cooling cavity(ies) 174. The securing can include any now known or later developed process. In one embodiment, attaching insert 380 may include brazing and/or heating the PSP material layer(s). In this fashion, the PSP material layers (e.g., outer layers 404 and/or 406) may soften, allowing easy installation, followed by strong adherence in tip rail pocket 370 upon cooling. Any now known or later developed manufacturing techniques may be additionally applied where necessary to couple insert 380 into pocket 370, e.g., heat application to ease insertion, etc. Once secured, insert 380 in tip rail pocket 370 fluidly connects coolant collection plenum 484 to internal cooling cavity(ies) 174, such that coolant can flow through plenum 484 to insert cooling channel(s) 482 to cool tip rail 250. Coolant can exit through exit apertures(s) 522 (FIG. 31).

Figure 32:
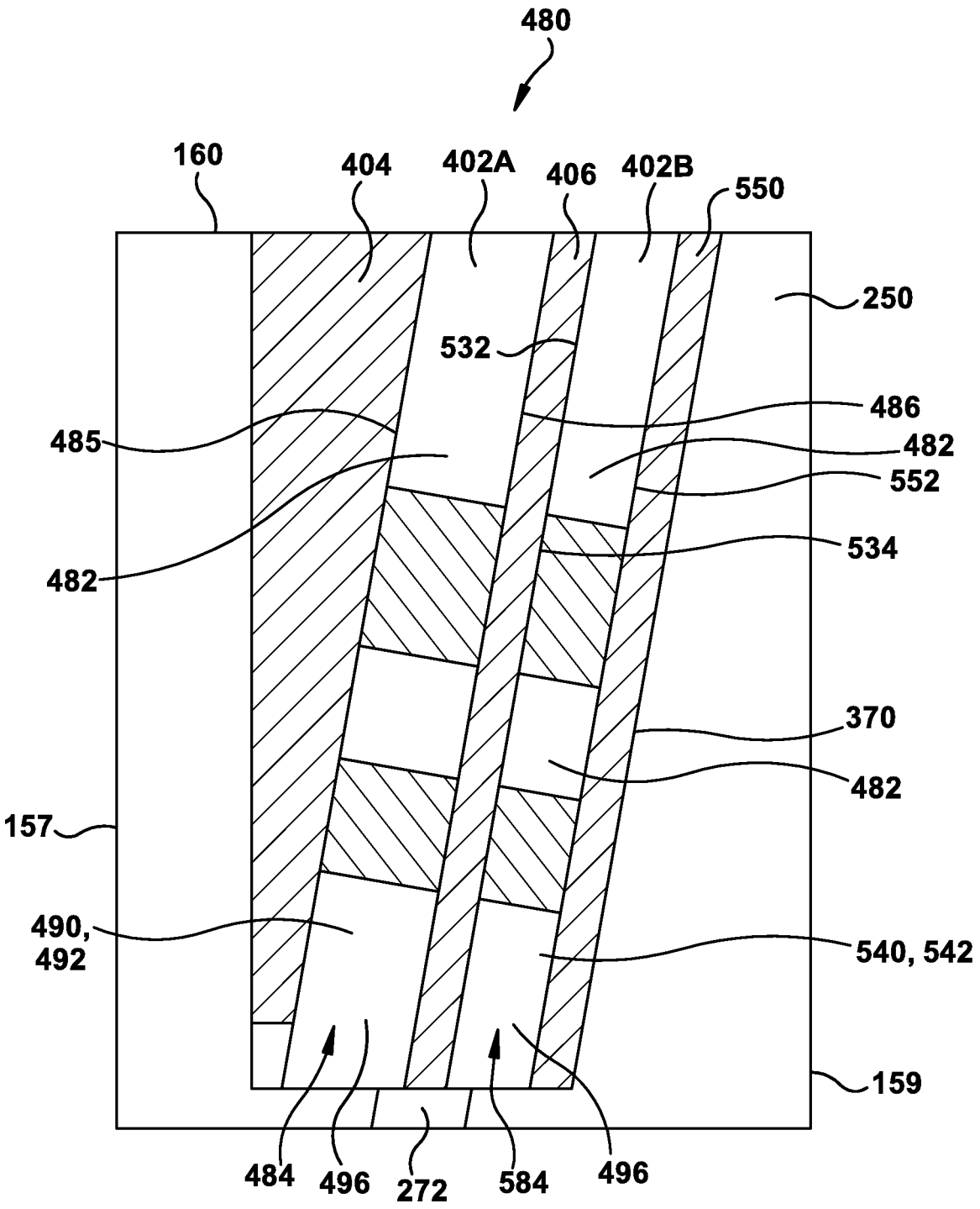
FIG. 32 is a cross-sectional end view of a tip rail cooling insert in a final inserted position in a tip rail pocket, according to yet other embodiments of the disclosure.

FIG. 32 shows another embodiment of an insert 480 that includes the structure of insert 380 and additionally another inner layer 402 and outer layer 550. Insert 480 includes (first) inner layer 402A that acts as a central body for insert 480 and defines at least one first insert cooling channel 482 (FIG. 25) therein, and a (second) inner layer 402B that acts as a central body for insert 480 and defines at least one first insert cooling channel 482 (FIG. 25). That is, second inner layer 402B defines at least one second insert cooling channel 482 therein. Inner layers 402A, 402B can be the same, or they can be different to provide different cooling. Insert 480 may also include a first outer layer 404 on a first side 485 of first inner layer 402A; and a second outer layer 406 on a second side 486 of first inner layer 402A. Second inner layer 402B has a first side 532 thereof on an opposing side 534 of second outer layer 406 from first inner layer 402A.

Each inner layer 402A, 402B may be similar to those described previously herein, e.g., as described relative to FIG. 25. To this end, second inner layer 402B may include a second pair of spaced legs 540, 542 (and perhaps additional legs 510) defining a second coolant collection plenum 584 for directing coolant from at least one internal cooling cavity 174 to second insert cooling channel(s) 482 in second inner layer 402B. As shown in FIG. 25, each of the second pair of spaced legs 540, 542 may have an angled outer end 496 configured to accommodate the rounded inner corners 372 (FIGS. 26-27) of a respective tip rail pocket 370. Insert 480 may also include a third outer layer 550 on a second side 552 of second inner layer 402B. Third outer layer 550 may be of the same material as outer layers 404, 406, e.g., a PSP material.

While the disclosure shows insert cooling channel(s) 282, 382, 482 in particular patterns, it is understood that patterns from the different embodiments can be intermixed. For example, at least one of insert cooling channel(s) 282, 382, 482 in insert 280, 380, 480 could have a serpentine pattern, a crossing pattern and/or a helical pattern, and at least one other could have one of the other patterns. Some of the inserts described herein must be additively manufactured; however, others can be formed using casting or a material removing technique, perhaps with electro-discharge machining (EDM), wire EDM and/or laser cutting to create certain features, e.g., insert cooling channels, coolant collection plenums, etc.

While particular examples of insert cooling channel(s) have been illustrated herein, it is understood that others are possible and considered within the scope of the disclosure. Any of the variety of cooling channel arrangements described herein or otherwise available can include adaptive cooling channels, i.e., those allowing opening of other cooling channels when one is destroyed or clogged. In this fashion, insert cooling channel(s) can form redistribution manifolds interconnecting any of a variety of branch cooling circuits for continued cooling operation during rubs that remove tip rail material or clog indiscriminate upper channels and/or exit apertures.

Embodiments of the disclosure provide improved and selectable blade tip cooling to reduce cooling flow requirements. The insert cooling channel(s) can take a variety of forms to provide a wide variety of desired cooling. The tip rail cooling insert allows for selectively placed cooling of the tip rail in used or new turbine blades. That is, tip rail cooling insert can deliver coolant to those areas of the tip and/or tip rail, e.g., the suction side, aft portion thereof, requiring additional cooling compared to other parts of the tip. The tip rail cooling insert may also improve cooling of the tip rail while metering coolant therethrough. The tip rail cooling insert may also address dust clogging. The airfoil 124, tip 137, 237, and/or insert 280, 380, 480 can be manufactured using any now known or later developed process. However, it is noted that many embodiments of insert lend themselves especially to additive manufacture.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and the practical application and to enable others of ordinary skill in the art to understand the disclosure for various embodiments with various modifications as are suited to the particular use contemplated.

What is claimed is:

1. A tip rail cooling insert for attaching into a tip rail pocket in a tip rail of a turbine blade, the tip rail cooling insert including:

a first inner layer defining at least one first insert cooling channel therein, the first inner layer including a first pair of spaced legs defining a first coolant collection plenum with at least the tip rail pocket for directing coolant from at least one internal cooling cavity in the turbine blade to the at least one first insert cooling channel, wherein each leg of the first pair of spaced legs has an angled outer end configured to accommodate rounded inner corners of the tip rail pocket;

a first outer layer on a first side of the first inner layer; and a second outer layer on a second side of the first inner layer.

2. The tip rail cooling insert of claim 1, wherein the first outer layer has a first end having a larger width than a second end, creating a wedge cross-sectional shape; and wherein the second outer layer is planar, creating a rectangular cross-sectional shape.

3. The tip rail cooling insert of claim 1, wherein, with the tip rail cooling insert in the tip rail pocket, the first inner layer defines a first radially open coolant exit aperture in a radial outer surface thereof; and wherein a radially outer surface of each of the first and second outer layers and the radial outer surface of the first inner layer are coplanar with an end surface of the tip rail.

4. The tip rail cooling insert of claim 1, wherein the first inner layer includes an additional leg extending to an inner surface of the tip rail pocket in a spaced manner between the first pair of spaced legs, the additional leg segmenting the first coolant collection plenum into a pair of coolant collection plenums, each coolant collection plenum directing coolant from the at least one internal cooling cavity in the turbine blade to a respective first insert cooling channel.

5. The tip rail cooling insert of claim 1, further comprising:

a second inner layer having a first side thereof on an opposing side of the second outer layer from the first inner layer, the second inner layer defining at least one second insert cooling channel therein, the second inner layer including a second pair of spaced legs defining a second coolant collection plenum for directing coolant from the at least one internal cooling cavity to the at least one second insert cooling channel, wherein each leg of the second pair of spaced legs has an angled outer end configured to accommodate the rounded inner corners of the tip rail pocket; and a third outer layer on a second side of the second inner layer.

6. The tip rail cooling insert of claim 1, wherein the first inner layer has a length greater than each of the first and second outer layers.

7. A turbine blade tip cooling system, comprising:

a turbine blade having a tip cavity, a tip rail surrounding at least a portion of the tip cavity, and at least one internal cooling cavity that carries a coolant;

the tip rail having an inner rail surface, an outer rail surface, an end surface and a tip rail pocket open at the end surface and fluidly connected to the at least one internal cooling cavity, the tip rail pocket having rounded inner corners; and a tip rail cooling insert attached to the tip rail pocket, the tip rail cooling insert including:

a first inner layer defining at least one first insert cooling channel therein, the first inner layer including a first pair of spaced legs defining a first coolant collection plenum for directing coolant from the at least one internal cooling cavity to the at least one first insert cooling channel, wherein each leg of the first pair of spaced legs has an angled outer end configured to accommodate the rounded inner corners of the tip rail pocket;

a first pre-sintered preform (PSP) outer layer on a first side of the first inner layer; and a second PSP outer layer on a second side of the first inner layer.

8. The turbine blade tip cooling system of claim 7, wherein the first PSP outer layer has a first end having a larger width than a second end, creating a wedge cross-sectional shape; and wherein the second PSP outer layer is planar, creating a rectangular cross-sectional shape.

9. The turbine blade tip cooling system of claim 8, wherein the wedge cross-sectional shape has a first surface at an angle to a second, opposing surface, the angle being between 3.5° and 6.5°.

10. The turbine blade tip cooling system of claim 7, wherein the first inner layer defines the at least one first insert cooling channel including at least one first radially outer chamber; and wherein, in an initial insertion position of the tip rail cooling insert into the tip rail pocket, the at least one first radially outer chamber extends above a radially outer surface of at least one of the first and second PSP outer layers; and wherein, in a final insertion position of the tip rail cooling insert in the tip rail pocket, the at least one first radially outer chamber is opened creating a first radially open coolant exit aperture, and the radially outer surface of each of the first and second PSP outer layers and a radial outer surface of the first inner layer are coplanar with the end surface of the tip rail.

11. The turbine blade tip cooling system of claim 7, wherein the first inner layer has a length greater than each of the first and second PSP outer layers.

12. The turbine blade tip cooling system of claim 7, wherein the first inner layer defines the at least one first insert cooling channel including at least one first radially outer chamber that is radially open, creating a radially open coolant exit aperture in a radial outer surface of the first inner layer.

13. The turbine blade tip cooling system of claim 12, wherein a radially outer surface of each of the first and second PSP outer layers and the radial outer surface of the first inner layer are coplanar with the end surface of the tip rail.

14. The turbine blade tip cooling system of claim 7, wherein the tip rail cooling insert further includes:

a second inner layer having a first side thereof on an opposing side of the second PSP outer layer from the first inner layer, the second inner layer defining at least one second insert cooling channel therein, the second inner layer including a second pair of spaced legs defining a second coolant collection plenum for directing coolant from the at least one internal cooling cavity to the at least one second insert cooling channel, wherein each leg of the second pair of spaced legs has an angled outer end configured to accommodate the rounded inner corners of the tip rail pocket; and a third pre-sintered preform (PSP) outer layer on a second side of the second inner layer.

15. A method, comprising:

forming a tip rail pocket in an end surface of a tip rail of a turbine blade, the turbine blade having a tip cavity, the tip rail surrounding at least a portion of the tip cavity, and at least one internal cooling cavity configured to deliver a coolant, and wherein the tip rail pocket includes rounded inner corners and a tip rail pocket coolant opening in fluid communication with the at least one internal cooling cavity of the turbine blade;

inserting a tip rail cooling insert into the tip rail pocket, the tip rail cooling insert including:

a first inner layer defining at least one insert cooling channel therein, the first inner layer including a first pair of spaced legs defining a first coolant collection plenum for directing coolant from the at least one internal cooling cavity to the at least one first insert cooling channel, wherein each leg of the first pair of spaced legs has an angled outer end configured to accommodate the rounded inner corners of the tip rail pocket;

a first outer layer on a first side of the first inner layer; and a second outer layer on a second side of the first inner layer; and securing the tip rail cooling insert to the tip rail pocket to fluidly connect the first coolant collection plenum to the at least one internal cooling cavity.

16. The method of claim 15, wherein the first outer layer has a first end with a larger width than a second end, creating a wedge cross-sectional shape, and wherein the second outer layer is planar, creating a rectangular cross-sectional shape; and wherein inserting the tip rail cooling insert into the tip rail pocket includes using the wedge cross-sectional shape of the first outer layer to tighten the second outer layer and the first inner layer in the tip rail pocket.

17. The method claim 15, wherein the first inner layer defines the at least one first insert cooling channel including at least one first radially outer chamber; and wherein, after the inserting the tip rail cooling insert into the tip rail pocket, a portion of at least the first inner layer extends outwardly from the tip rail pocket.

18. The method of claim 17, wherein, after the inserting the tip rail cooling insert into the tip rail pocket, a desired depth of the tip rail cooling insert into the tip rail pocket based on a position of the at least one first radially outer chamber relative to at least one of a radially outer surface of at least one of the first and second outer layers and the end surface of the tip rail is confirmed.

19. The method of claim 15, wherein, after the inserting the tip rail cooling insert into the tip rail pocket, a coating is applied to the tip rail with at least one first radially outer chamber at an end of the at least one insert cooling channel collecting excess coating.

20. The method of claim 15, wherein, after the inserting the tip rail cooling insert into the tip rail pocket, the end surface of the tip rail and the tip rail cooling insert is planarized, the planarizing creating a first radially open coolant exit aperture from the at least one insert cooling channel, and the radially outer surface of the first and second outer layers and a radial outer surface of the first inner layer is made coplanar with the end surface of the tip rail.

* * * * *